US007456350B2

(12) United States Patent
Neumayer et al.

(10) Patent No.: US 7,456,350 B2
(45) Date of Patent: Nov. 25, 2008

(54) DRUM TUNING SYSTEM AND METHOD

(75) Inventors: Alfred Paul Neumayer, Vashon, WA (US); John Steven Russell, Vashon, WA (US)

(73) Assignee: Machttone Corp., Vashon, WA (US)

( * ) Notice: Subject to any disclaimer, the term of this patent is extended or adjusted under 35 U.S.C. 154(b) by 0 days.

(21) Appl. No.: 11/623,711

(22) Filed: Jan. 16, 2007

(65) Prior Publication Data

US 2008/0168888 A1 Jul. 17, 2008

(51) Int. Cl.
*G10D 13/08* (2006.01)

(52) U.S. Cl. ..... 84/411 R

(58) Field of Classification Search ..... 84/411 R, 84/421, 312 R

See application file for complete search history.

(56) References Cited

U.S. PATENT DOCUMENTS 4,714,002 A 12/1987 Cleland
5,447,087 A 9/1995 Hawes et al.
5,517,890 A 5/1996 Cooperman
7,244,882 B1 * 7/2007 Colwell ..... 84/312 R

* cited by examiner

*Primary Examiner*—Kimberly R Lockett
(74) *Attorney, Agent, or Firm*—George C. Rondeau, Jr.; Davis Wright Tremaine LLP

(57) ABSTRACT

An acoustic drum has various implementations for tuning, bracing, attachment, and snare strainer. These implementations are combined in differing configurations of the drum system. Certain aspects of some of the implementations are related to aspects of other of the implementations. For instance, a tuning implementation may use a particular attachment implementation, which in turn may use a certain bracing implementation. Because certain bracing implementations are used, a strainer implementation could be also used if the drum was a snare version. The implementations variously combine to affect performance and/or other esthetic qualities of the acoustic drum.

28 Claims, 49 Drawing Sheets

DRUM TUNING SYSTEM AND METHOD

BACKGROUND OF THE INVENTION

1. Field of the Invention

The present invention is directed generally to acoustic drums for performance of music.

2. Description of the Related Art

Conventional acoustic drum mechanisms have been developed for tuning, bracing, component attachment, and snare strainer. The mechanisms can differ as to assembly requirements, ease of use, and influence upon drum performance.

BRIEF DESCRIPTION OF THE SEVERAL VIEWS OF THE DRAWING(S)

DETAILED DESCRIPTION OF THE INVENTION

As will be discussed in greater detail herein, an acoustic drum has various implementations for tuning, bracing, attachment, and snare strainer. These implementations are combined in differing configurations of the drum system. Certain aspects of some of the implementations are related to aspects of other of the implementations. For instance, a tuning implementation may use a particular attachment implementation, which in turn may use a certain bracing implementation. Because certain bracing implementations are used, a strainer implementation could be also used if the drum was a snare version. The implementations variously combine to affect performance and/or other esthetic qualities of the acoustic drum.

Figure 1:
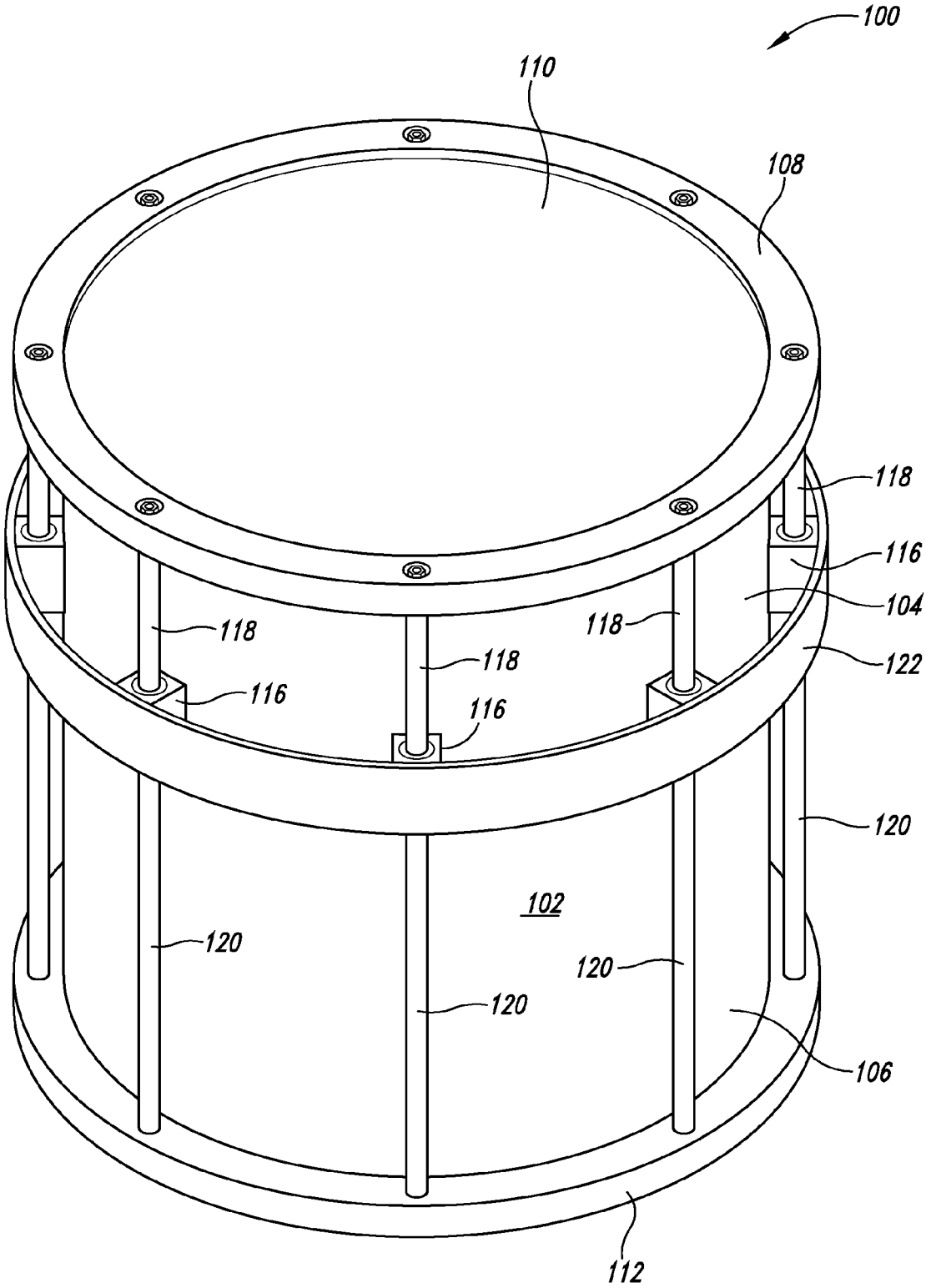
FIG. 1 is a perspective view of a drum incorporating aspects of the present invention.

A drum 100 is illustrated in FIG. 1 to include a shell 102 having a curved peripheral surface to surround an interior and an upper end 104 and a lower end 106. The drum 100 has an upper rim 108 that assists with retaining an upper head 110. The drum further has a lower rim 112 that assists with retaining a lower head 114 (better shown in FIG. 3). Coupling members or support connectors 116 of a first tuning implementation are externally affixed to the shell 102 in a predetermined arrangement using a first attachment implementation. The predetermined arrangement is depicted in FIG. 1 as uniform, but may be non-uniform for particular applications.

For each of the support connectors 116, the first tuning implementation has an upper tuning bolt 118 coupled to and extending from the upper rim 108 to pass into and threadably couple with the support connector. Also, for each of the support connectors 116, a lower tuning bolt 120 extends from the lower rim 112 to pass into and threadably couple with the support connector. The extent of passage into the support connectors 116 by the upper tuning bolts 118 contributes in measure to the particular state of tension placed upon the upper head 110 and consequentially, in determining pitch of the upper head. In this implementation the upper tuning bolt 118 serves as an elongated member having a longitudinal dimension and having a passageway extending therethrough the longitudinal dimension. The lower tuning bolt 120 serves as an elongated member having a first end portion engageable with a first end portion of a tool member described below.

In a similar manner, the extent of passage into the support connectors 116 by the lower tuning bolts 120 contributes in measure to the particular state of tension placed upon the lower head 112 and consequentially, in determining pitch of the lower head. A circumferential brace 122 is affixed by the first attachment implementation to each of the tuning supports 116 and extending therebetween. The circumferential brace 122 can be used for additional structural integrity and/or cosmetic purposes.

Figure 2:
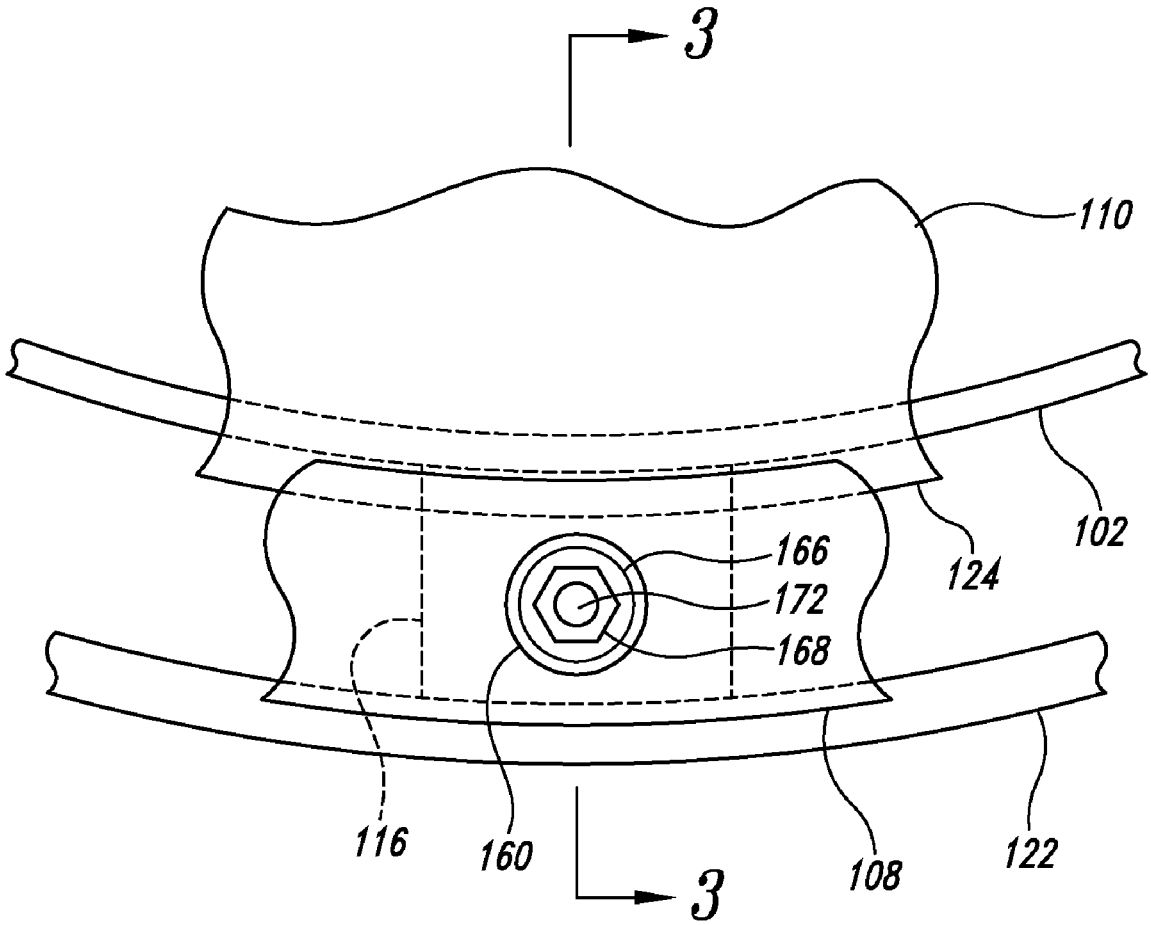
FIG. 2 is an enlarged top plan view of a sectional portion of the drum of FIG. 1 showing detail of the first tuning implementation.
Figure 3:
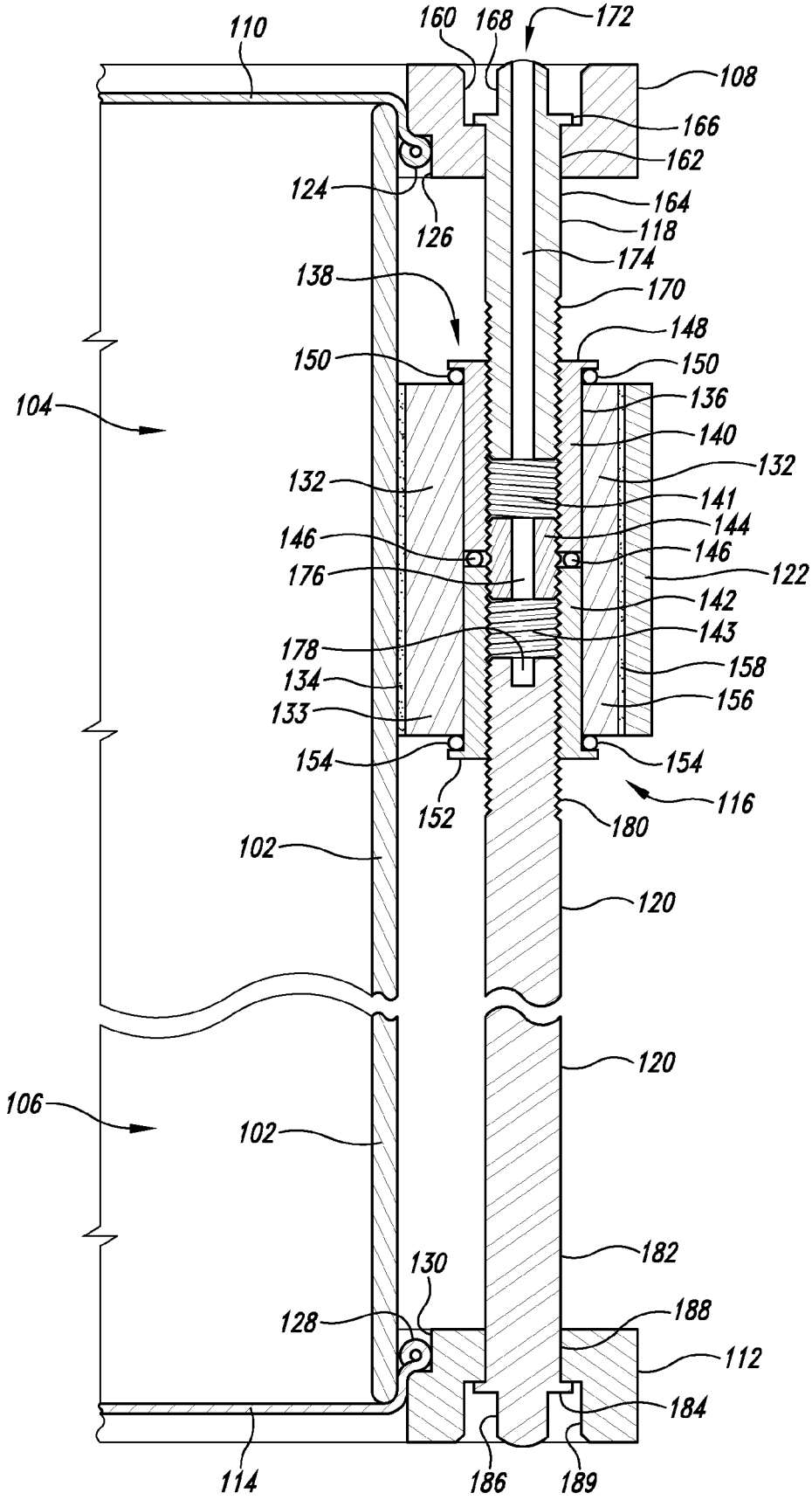
FIG. 3 is a cross-sectional side elevational view of a sectional portion of the drum taken along the 3-3 line of FIG. 2 showing detail of a first tuning implementation and of a first attachment implementation.

As shown in FIG. 2 and better shown in FIG. 3, a peripheral portion 124 of the upper head 110 is engaged with a notched portion 126 of the upper rim 108. A peripheral portion 128 of the lower head 114 is engaged with a notched portion 130 of the lower rim 112. In the first tuning implementation, each of the support connectors 116 includes a block 132 having an interior portion 133 that is a affixed to the shell 102 by a bonding material 134 of the first attachment implementation. In some versions of the drum 100, the first attachment implementation allows for bonding of a wood version of the shell 102 to a wood version of the support connectors 116 thus eliminating much of the metal content that is found in a conventional drum.

In some implementations, the bonding material 134 may be from adhesive films such as thermo plastic polyurethane glues, polyester films, or polyolefin films such as made available by Bemis Associates. Such films are also useful for veneer bonding. The films can come in the form of a film or sheet such as approximately 5 mils thick. The films can be cut to size, inserted in between surfaces to be bonded with heat and pressure being applied.

Other glues that can be used for the bonding material 134 include Unibond 800, which is a urea resin glue manufactured by Vacuum Pressing Systems, Inc., Weldwood, which is a urea formaldehyde glue made by DAP, Inc., cyanoacrylate superglues, polyurethane glues such as Gorilla glue, which is a 60%-70% urethane prepolymer and a 30-40% polymeric MDI (MDI stands for 4,4-Diphenylmethane diisocyanate with monomers, isomers, and homopolymers) made by the Gorilla Glue Company, Titebond yellow wood glues or other glues made by Franklin International, a two-part epoxy such as Scotch-Weld 2216 made by 3M, depending on the wood species or other material to be bonded, such as carbon fiber. Some versions may use metal, such as stainless steel, for the support connectors 116 and/or the upper tuning bolts 118 and the lower tuning bolts 120. Bonding of metals can also be done using silver solder or adhesive films.

The block 132 has a hole 136 that receives a dual-threaded collar 138 with an upper section 140 having a threaded opening 141 with right-handed threads and a lower section 142 having a threaded opening 143 with left-handed threads both threadably engaged with a center bolt 144. A center o-ring 146 is positioned to seal between the upper section 140 and the lower section 142. The upper section 140 has a flange 148 with an o-ring 150 positioned to seal against an upper surface of the block 132. The lower section 142 has a flange 152 with an o-ring 154 positioned to seal against a lower surface of the block 132. The circumferential brace 122 is shown affixed to an exterior portion 156 of the block 132 by bonding material of the first attachment implementation.

The upper rim 108 has a counter-sink 160 and hole 162 that receives the upper tuning bolt 118. The upper tuning bolt 118 has an upper section 164 bounded by a flange 166 and a head 168 at an end of the upper tuning bolt. A portion of the upper section 164 of the upper tuning bolt 118 is positioned to pass through the hole 162 with the flange 166 preventing further advance. The upper tuning bolt 118 has a lower threaded section 170, which engages with the threaded opening 141 of the upper section 140 of the dual-threaded collar 138.

A bore 172 includes an upper bore portion 174 passing longitudinally through the upper tuning bolt 118, a center bore portion 176 passing longitudinally through the center bolt 144, and a lower bore portion 178 passing longitudinally into an upper threaded section 180 of the lower tuning bolt 120. The bore 172 includes a lower portion of the threaded opening 141 of the upper section 140 of the collar 138 that is not engaged with either the upper tuning bolt 118 or the center bolt 144. The bore 172 further includes an upper portion of the threaded opening 143 of the lower section 142 of the collar 138 that is not engaged with either the lower tuning bolt 120 or the center bolt 144.

The lower tuning bolt 120 has an upper threaded section 180 and a lower section 182, which is bounded by a flange 184 dividing a head 186. A portion of the lower section 182 is positioned to pass through a hole 188 in the lower rim 112 with the flange 184 and the head 186 positioned in a countersink 189 of the lower rim.

Figure 4:
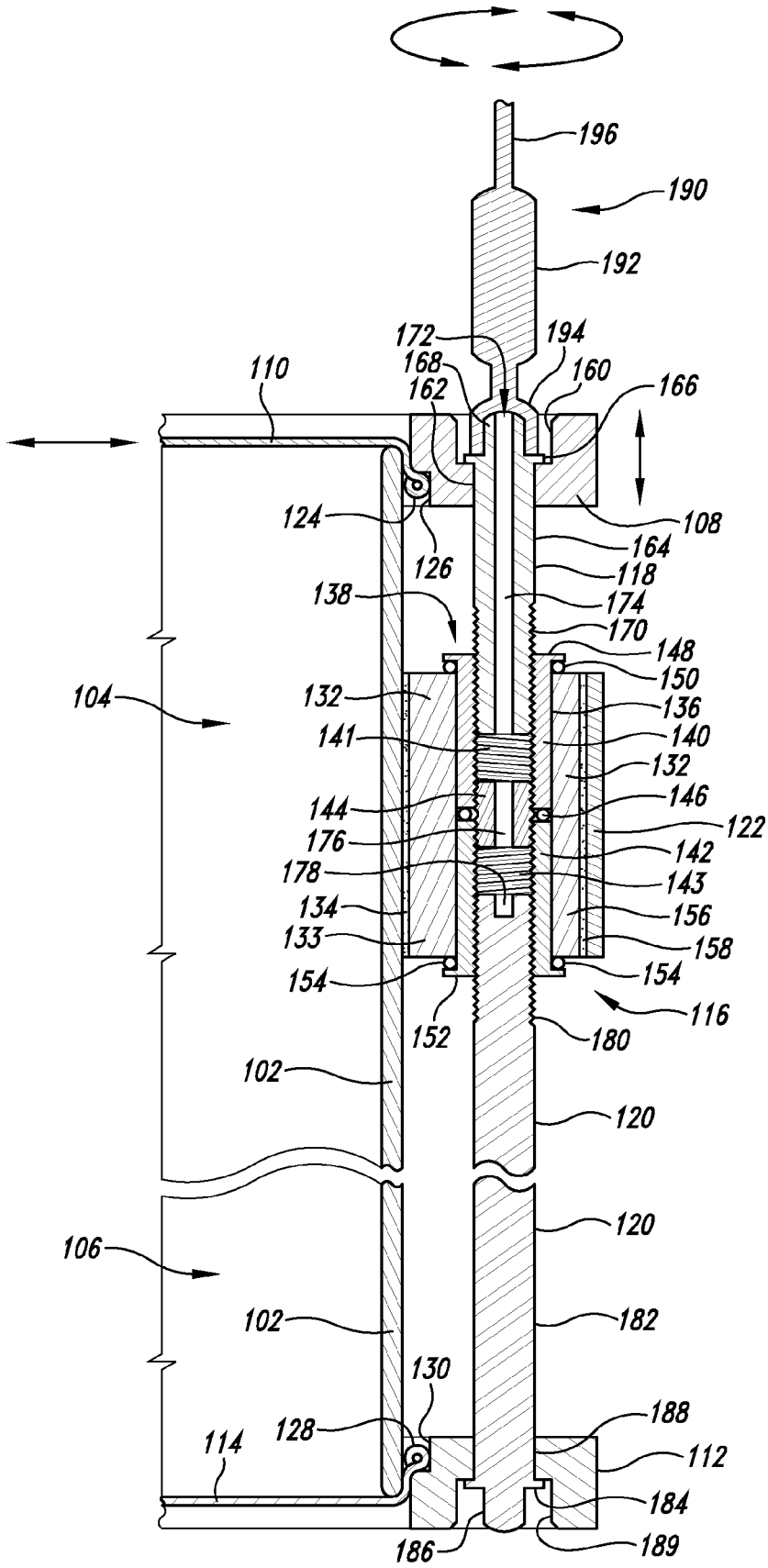
FIG. 4 is a cross-sectional side elevational view of an adjustment tool being used in an upper tuning position with the first tuning implementation of FIG. 2.
Figure 5:
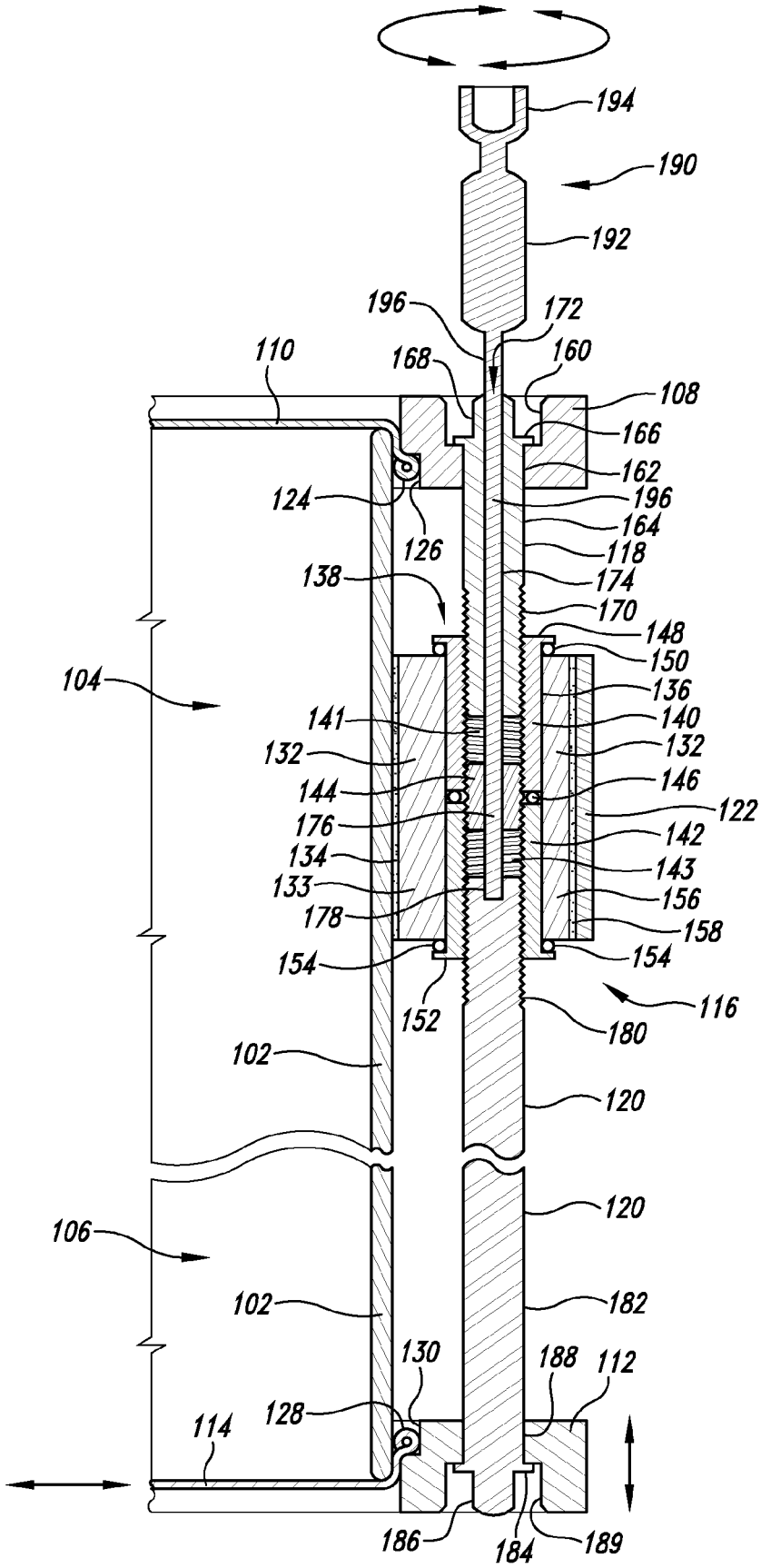
FIG. 5 is a cross-sectional side elevational view of the adjustment tool of FIG. 4 being used in a lower tuning position with the first tuning implementation of FIG. 2.

An elongated tool member or adjustment tool 190 is shown in FIGS. 4 and 5 to include a body 192. Extending from the body 192 in a first direction is a head engaging portion 194, such as a socket head, and in an opposite second direction is a bore engaging portion 196, such as a hex end. The adjustment tool 190 is shown in FIG. 4 as engaging the head engaging portion 194 with the head 168 of the upper tuning bolt 118 to rotate the upper tuning bolt either clockwise or counterclockwise about its longitudinal axis as the adjustment tool 190 is being rotated clockwise or counterclockwise, respectively.

A clockwise rotation of the adjustment tool 190 results in a clockwise rotation of the upper tuning bolt 118 and in movement of the upper tuning bolt further into the upper section 140 of the dual-threaded collar 138 and a consequential increase in tension on the upper drum head 110. A counterclockwise rotation of the adjustment tool 190 results in a counterclockwise rotation of the upper tuning bolt 118 and in movement of the upper tuning bolt back out of the upper section 140 of the dual-threaded collar 138 and a consequential decrease in tension on the upper drum head 110.

The adjustment tool 190 is shown in FIG. 5 as engaging the bore engaging portion 196 with the bore 178 of the lower tuning bolt 120 to rotate the lower tuning bolt about its longitudinal axis as the adjustment tool is rotated. In the depicted implementation, the lower tuning bolt 120 has a left-handed thread so that a clockwise rotation of the adjustment tool 190 results in movement of the lower tuning bolt further into the lower section 142 of the dual-threaded collar 138 and a consequential increase in tension on the lower drum head 114. On the other hand, a counterclockwise rotation of the adjustment tool 190 results in movement of the lower tuning bolt 120 back out of the lower section 142 of the dual-threaded collar 138 and a consequential decrease in tension on the lower drum head 114.

Figure 6:
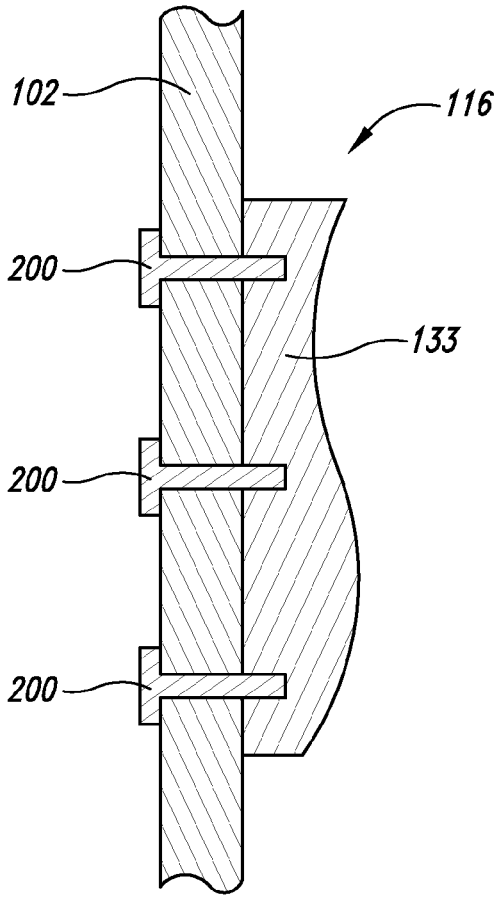
FIG. 6 is a cross-sectional side elevational view of a sectional portion of a drum showing detail of a second attachment implementation.
Figure 7:
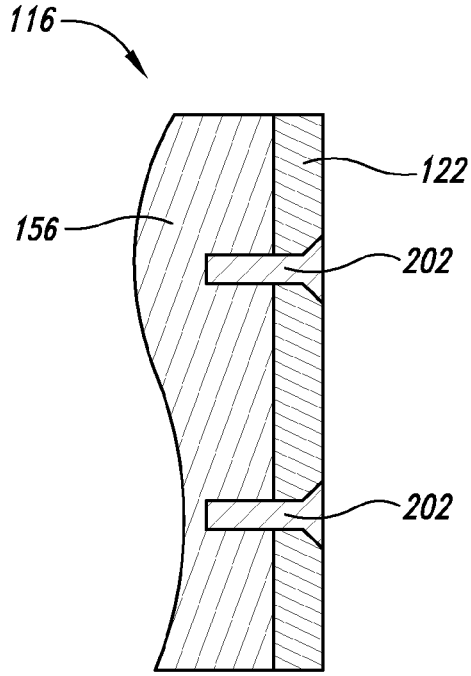
FIG. 7 is a cross-sectional side elevational view of a sectional portion of the drum of FIG. 6 showing additional detail of the second attachment implementation.

As shown in FIG. 6, coupling bolts 200 penetrate through the shell 102 to affix the interior portion 133 of the block 132 to the shell by a second attachment implementation. Also, by the second attachment implementation, screws 202 can be countersunk into the circumferential brace 122 to affix the exterior portion 156 of the block 132 to the circumferential brace as shown in FIG. 7.

Figure 8:
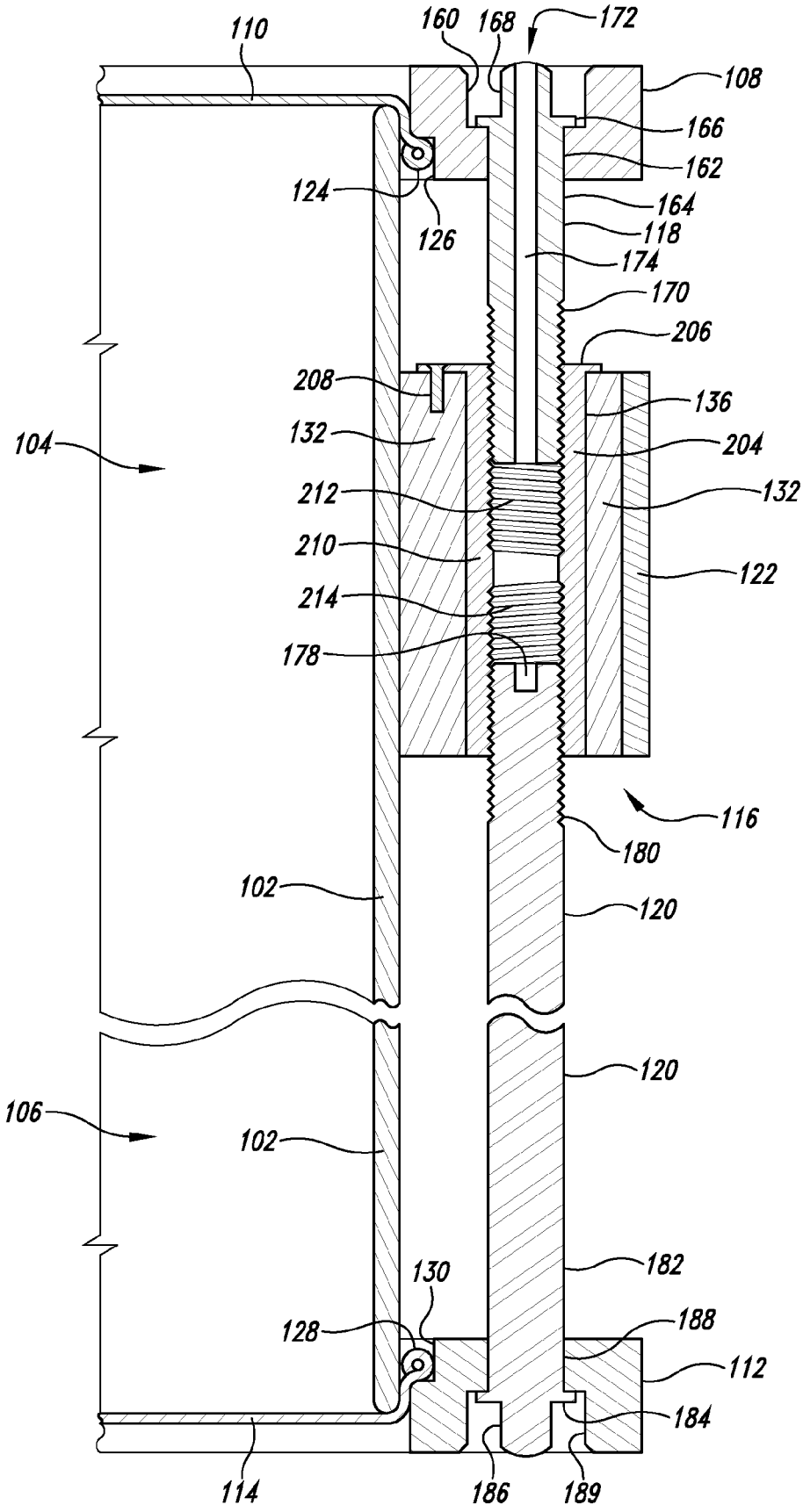
FIG. 8 is a cross-sectional side elevational view of a sectional portion of a drum having the first tuning implementation of FIG. 2 with a second coupling collar.

As shown in FIG. 8, a dual-threaded collar 204 has a flange 206 that is sized to receive a set screw 208 that passes through the flange into the block 132 to affix the collar to the block. The collar 204 has a single section 210 that has right-hand threads 212 in an upper portion of the section and left-hand threads 214 in a lower portion of the section. The right-hand threads 212 are positioned to function similarly to the threads of the threaded opening 141 of the upper section 140 of the collar 138 with respect to movement of the upper tuning bolt 118 as described above. The left-hand threads 214 are positioned to function similarly to the threads of the threaded opening 143 of the lower section 142 of the collar 138 with respect to movement of the lower tuning bolt 120 also described above.

Figure 9:
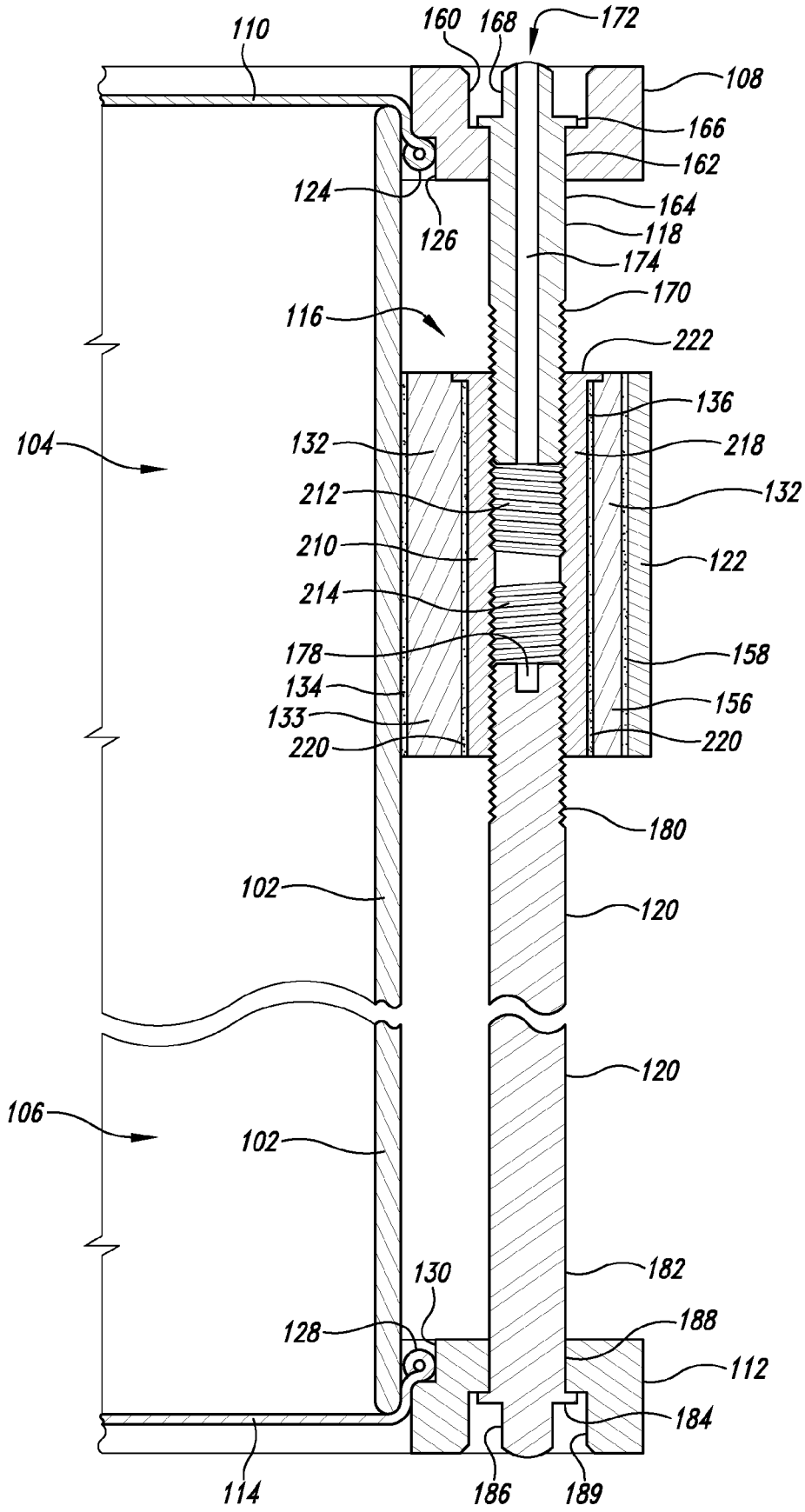
FIG. 9 is a cross-sectional side elevational view of a sectional portion of a drum having the first tuning implementation of FIG. 2 with a third coupling collar.
Figure 10:
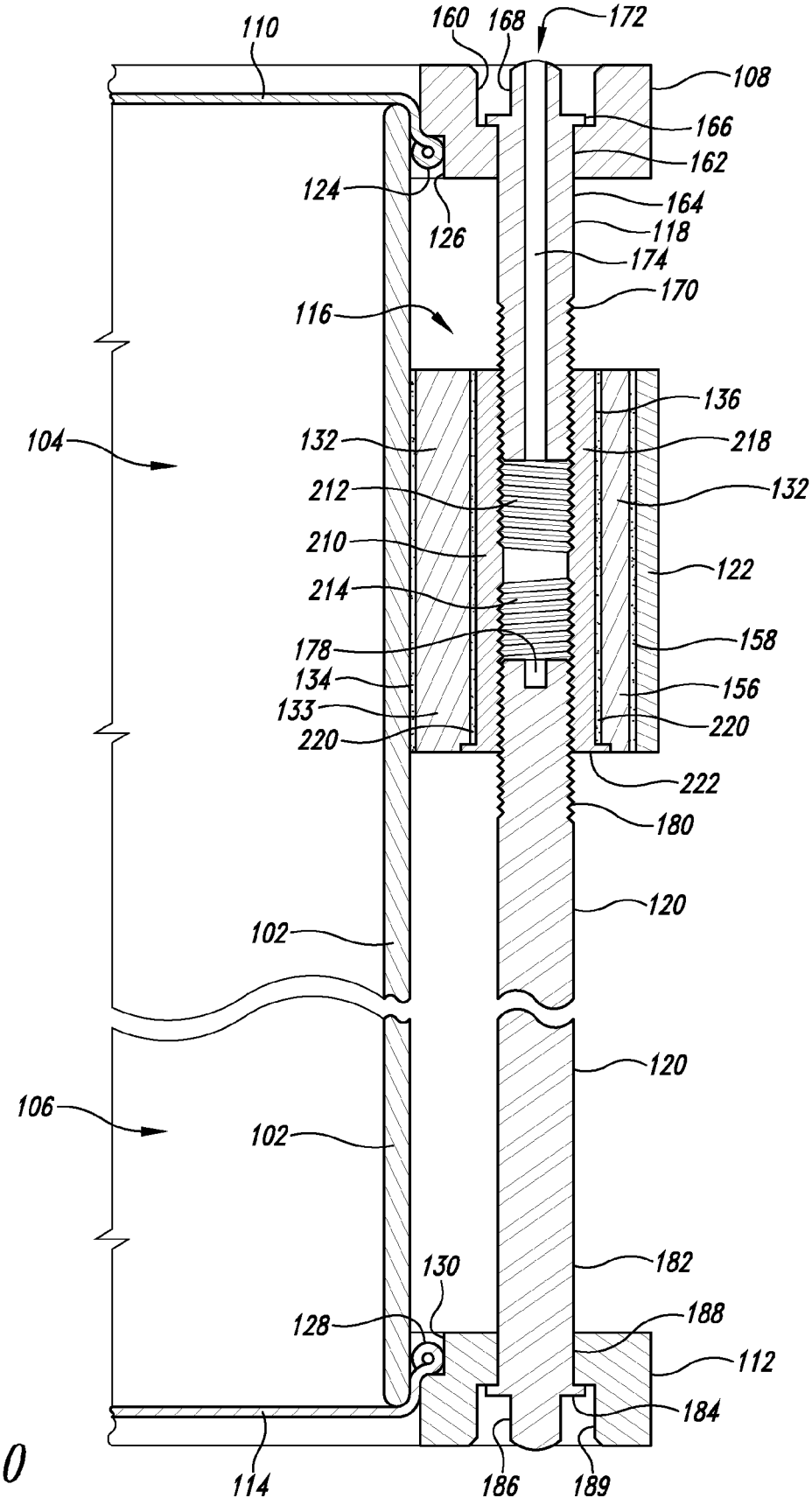
FIG. 10 is a cross-sectional side elevational view of a sectional portion of a drum having the first tuning implementation of FIG. 2 with a fourth coupling collar.

As shown in FIG. 9, a dual-threaded collar 218 is affixed to the block 132 with bonding material 220 from the first attachment implementation. The collar 218 has a flange 222 that is countersunk into the block 132. In FIG. 10, for another application, the collar 218 is inverted so that the flange 222 is countersunk into the bottom of the block 132.

Figure 11:
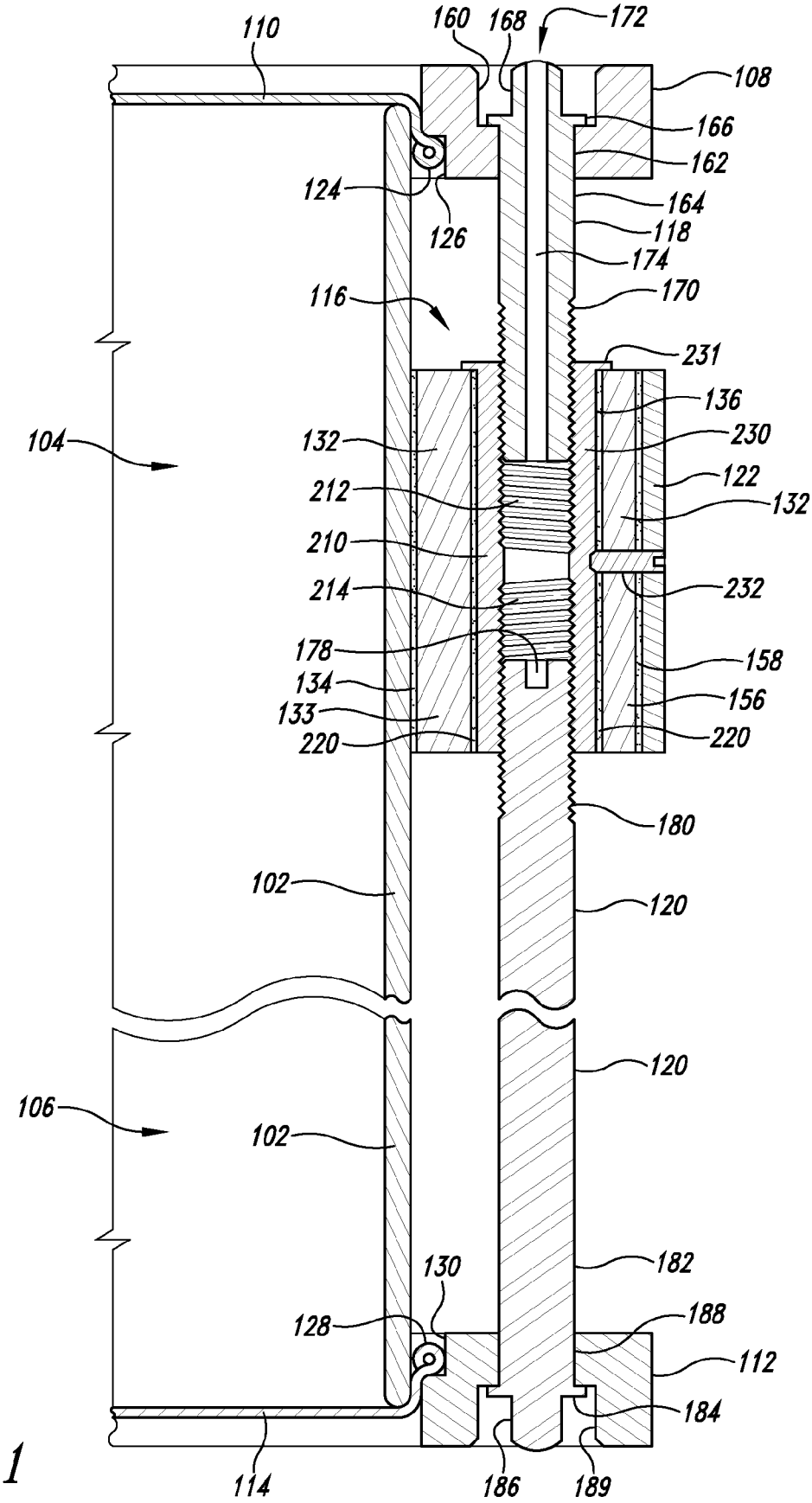
FIG. 11 is a cross-sectional side elevational view of a sectional portion of a drum having the first tuning implementation of FIG. 2 with a fifth coupling collar.

A dual-threaded collar 230 has a flange 231 as shown in FIG. 11. A set screw 232 passes through the circumferential brace 122 and the block 132 to engage with the collar 230 thereby affixing the collar with the block.

Figure 12:
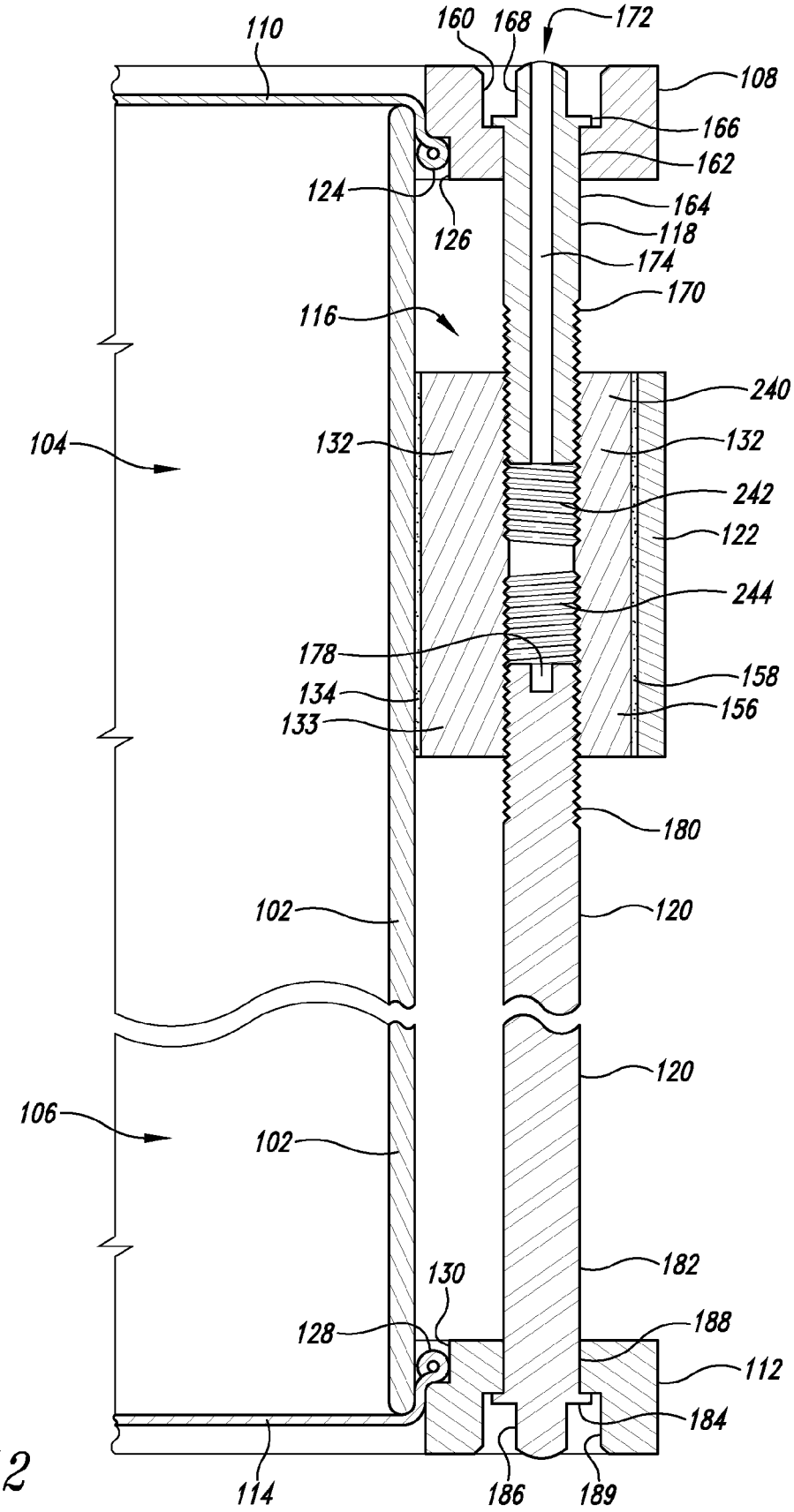
FIG. 12 is a cross-sectional side elevational view of a sectional portion of a drum having the first tuning implementation of FIG. 2 with a second support block.

A dual-threaded block 240, which is an alternative version of the block 132 that can be made from metal or other material of sufficient stiffness to be internally threaded is shown in FIG. 12 to an upper portion 242 of an opening with right hand threads to receive the upper tuning bolt 118 and a lower portion 244 with left hand threads to receive the lower tuning bolt 120. In this implementation, the dual-threaded block 240 does not require a version of a dual-threaded collar.

Figure 13:
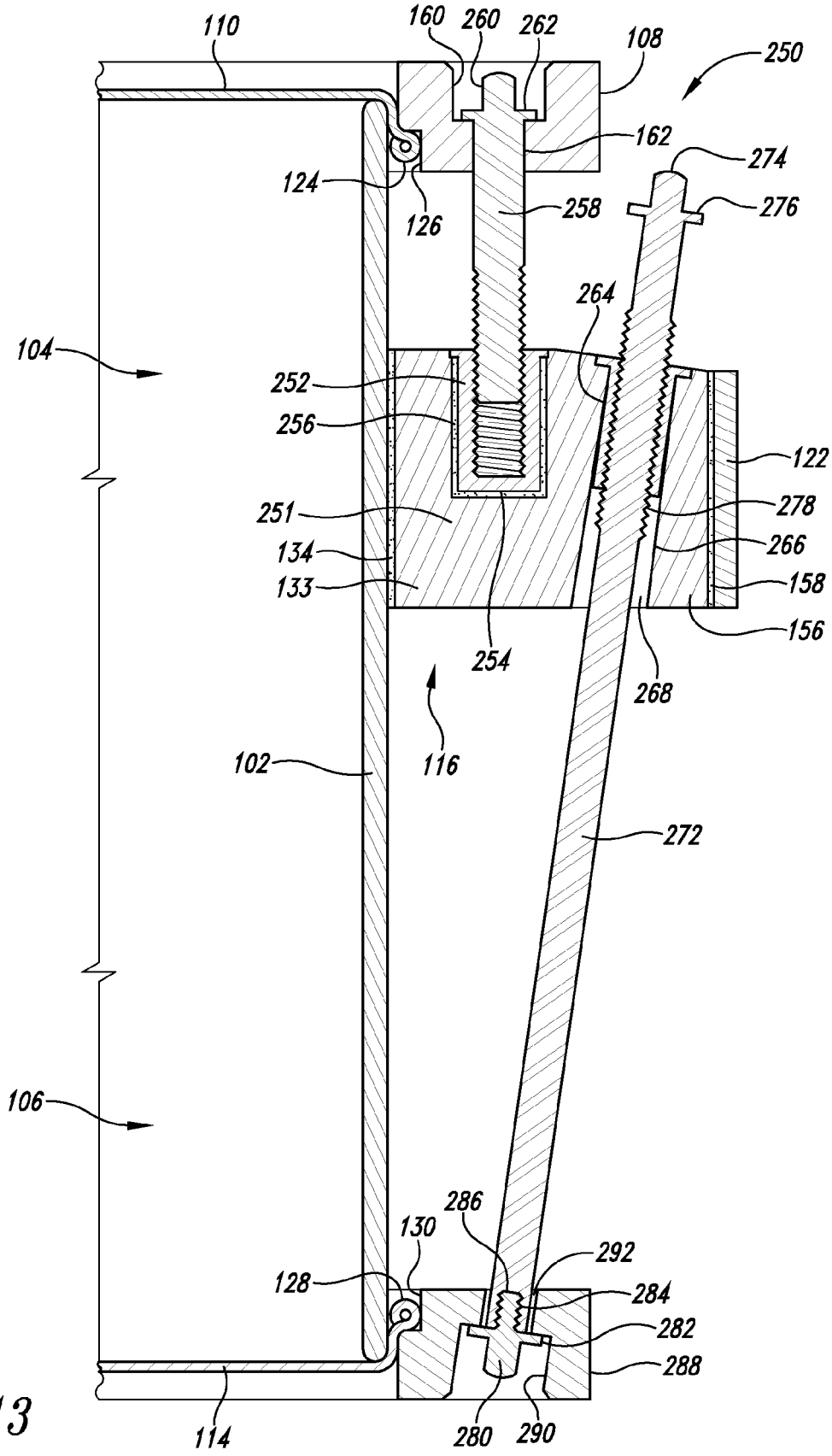
FIG. 13 is a cross-sectional side elevational view of a sectional portion of a drum showing detail of a second tuning implementation.

A second tuning implementation is shown in FIG. 13 as having a dual support connector 250 including a block 251. The dual support connector 250 has an upper collar 252 positioned in an upper opening 254 of the block 251 and affixed to the block by a bonding material 256. The upper collar 252 threadably engages with an upper tuning bolt 258, which has a head 260 and a flange 262 to receive a tuning tool such as one having the head engaging portion 194 of the adjustment tool 190. The upper tuning bolt 258 is positioned in the upper rim 108 in a manner similar to that described above for the upper tuning bolt 118. The upper tuning bolt 258, however, does not have a bore through its longitudinal axis. As the upper tuning bolt 258 is rotated clockwise and counter-clockwise with a tuning tool, the upper head is tightened and loosened, respectively.

The dual support connector 250 further has a lower collar 264 that is positioned in a lower opening 266 in the block 251 in a non-coaxial version of the lower collar. The lower opening has a widened end 268, which allows for removal of a lower tuning bolt 272 shown threadably engaged with the lower collar 264. The lower tuning bolt 272 has an upper head 274 and an upper flange 276 to receive a tuning tool such as one having the head engaging portion 194 of the adjustment tool 190. The lower tuning bolt 272 has an upper threaded portion 278 that engages with the lower collar 264. The lower tuning bolt 272 has a lower head 280 with a lower flange 282 and a lower threaded portion 284, which engages with a threaded bottom opening 286. A lower rim 288 has an angled counter-sink 290 and an angled opening 292 that receives the lower tuning bolt 272.

Figure 14:
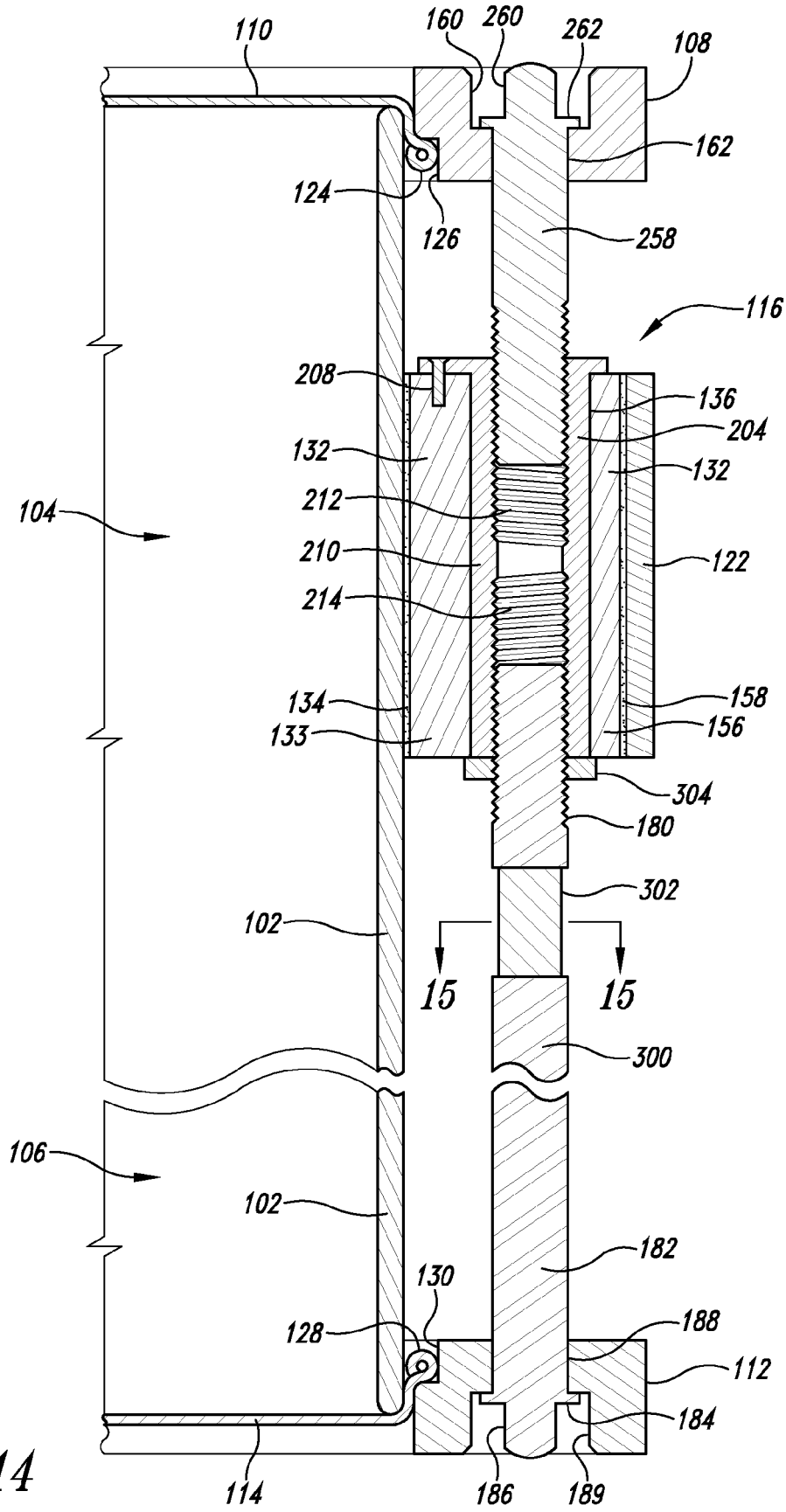
FIG. 14 is a cross-sectional side elevational view of a sectional portion of a drum showing detail of a third tuning implementation.
Figure 15:
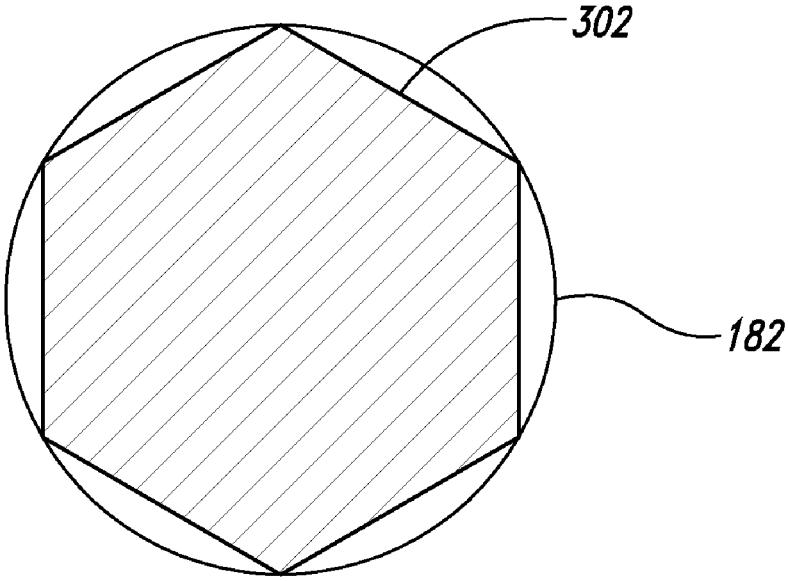
FIG. 15 is a cross-sectional top plan view of a tuning bolt of the third tuning implementation.

A third tuning implementation is shown in FIG. 14 as having a lower bolt 300 being received by the lower rim 112 for tuning of the lower head 114. The lower bolt 300 has an angular surface portion 302, inscribed as shown in FIG. 15, into the lower section 182 of the lower bolt. The angular surface portion 302 is sized and shaped to receive an open-end hex wrench (not shown) for rotation of the lower bolt and subsequent tuning adjustment of the lower head 114. Other implementations are configured to receive other adjustment tools to be inserted from the side of the lower bolt 300. A lock nut 304 is used to secure engagement of the lower bolt 300 with the support connector 116.

Figure 16:
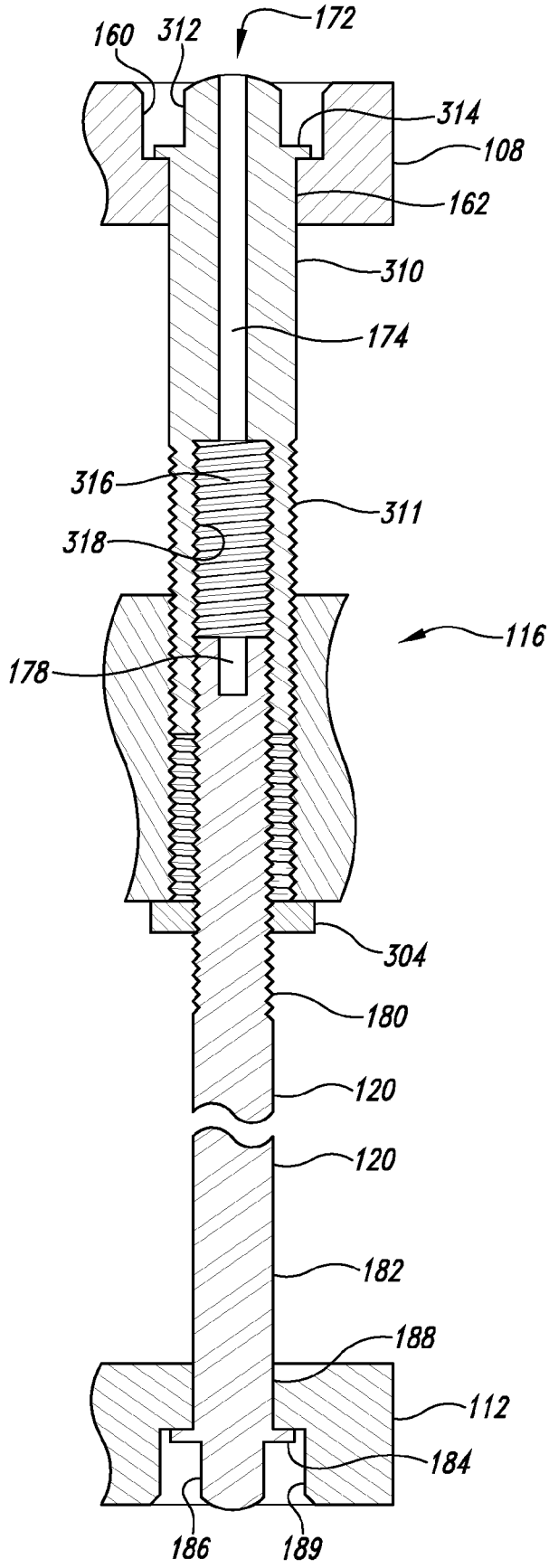
FIG. 16 is a cross-sectional side elevational view of a sectional portion of a drum showing detail of a fourth tuning implementation.

A fourth tuning implementation is shown in FIG. 16 as having an upper bolt 310 with external threads 311 that engage with the support connector 116. The upper bolt 310 has a head 312 and a flange 314 that are received by the upper counter-sink 160 of the upper rim 108. The head 312 receives a tuning tool such as one having the head engaging portion 194 of the adjustment tool 190 to rotate the upper bolt 310 for tuning of the upper head 110. The upper bolt 310 has an opening 316 with a threaded interior 318 that receives the upper threaded section 180 of the lower tuning bolt 120. The lower tuning bolt 120 is held in place with a locking nut 304 threaded onto the lower tuning bolt and tightened against the support connector 116.

Figure 17:
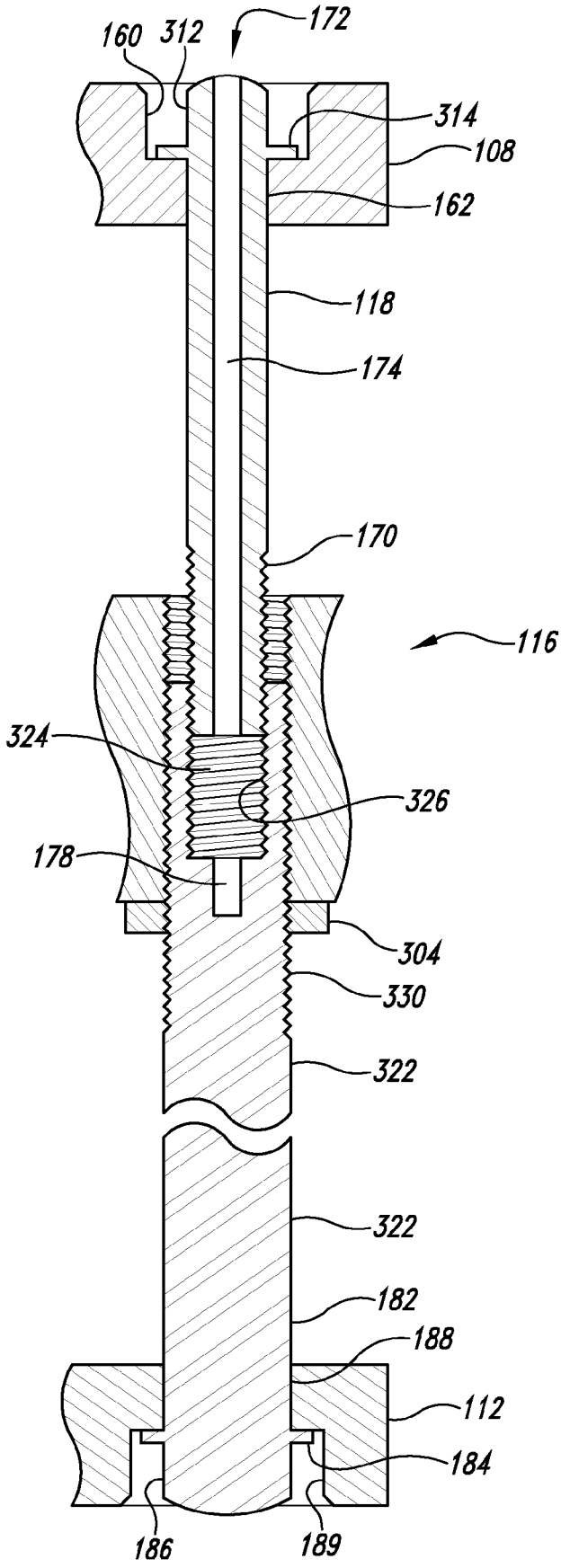
FIG. 17 is a cross-sectional side elevational view of a sectional portion of a drum showing detail of a fifth tuning implementation.

A fifth tuning implementation is shown in FIG. 17 as having a lower bolt 322 with an opening 324 having a threaded interior 326 to engage with the upper tuning bolt 118. The lower bolt 322 has external threads 330 that engage with the support connector 116.

Figure 18:
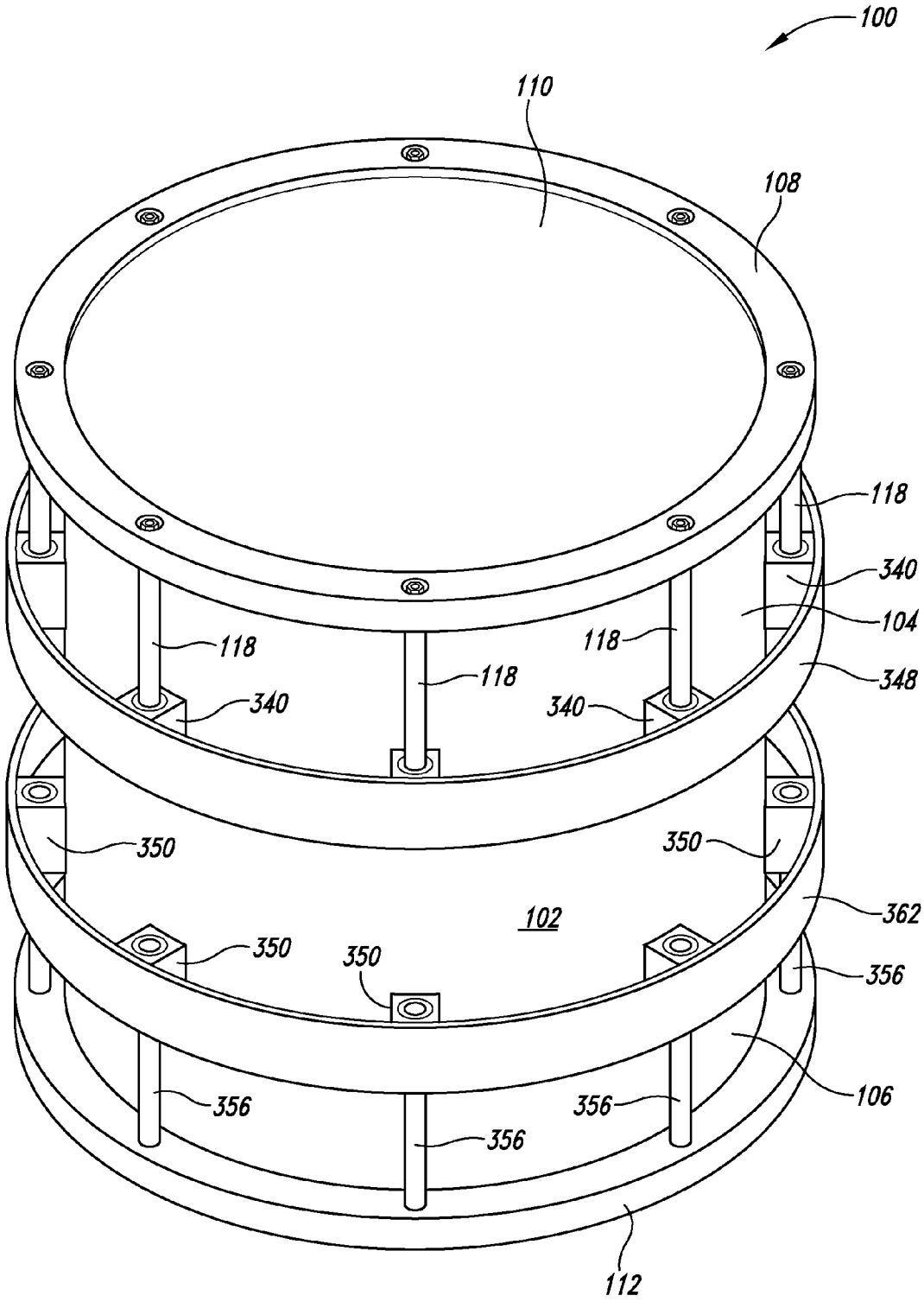
FIG. 18 is a perspective view of a drum having a sixth tuning implementation.
Figure 19:
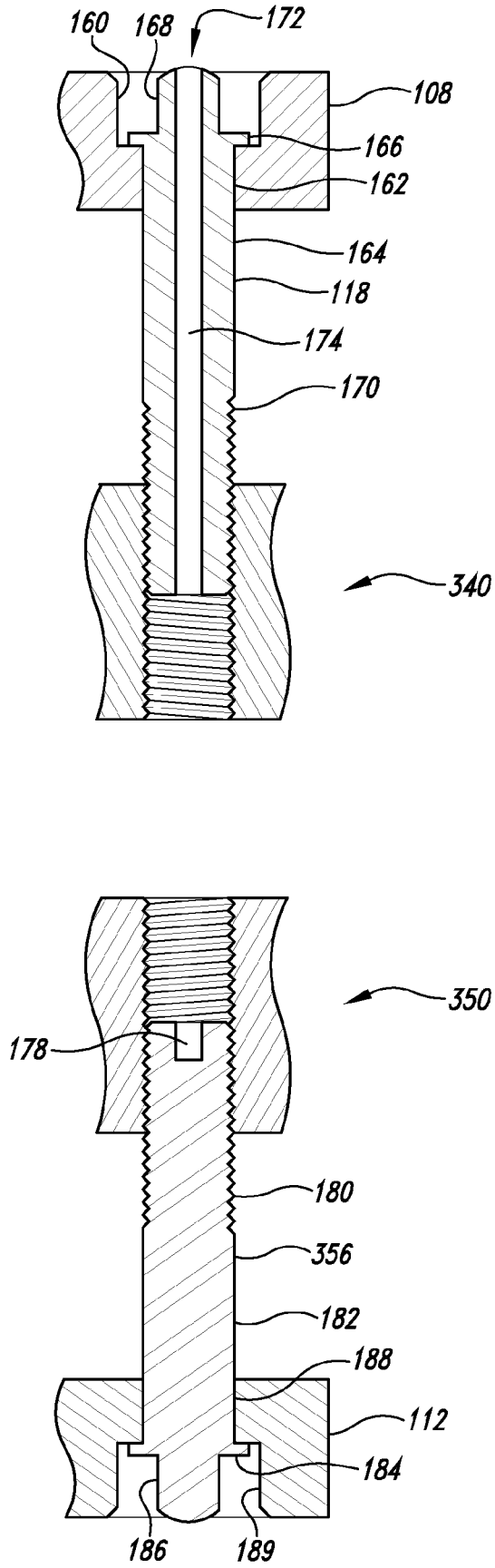
FIG. 19 is a cross-sectional side elevational view of a sectional portion of the drum of FIG. 18 showing detail of the sixth tuning implementation of FIG. 18.

A sixth tuning implementation is shown in FIGS. 18 and 19 as having the upper tuning bolt 118 engaged with its own separate upper support connector 340. The sixth tuning implementation allows for a separate upper circumferential brace 348 that is coupled to the upper support connectors 340. Lower support connectors 350 are each shown engaged with a different one of a plurality of lower tuning bolts 356.

Figure 20:
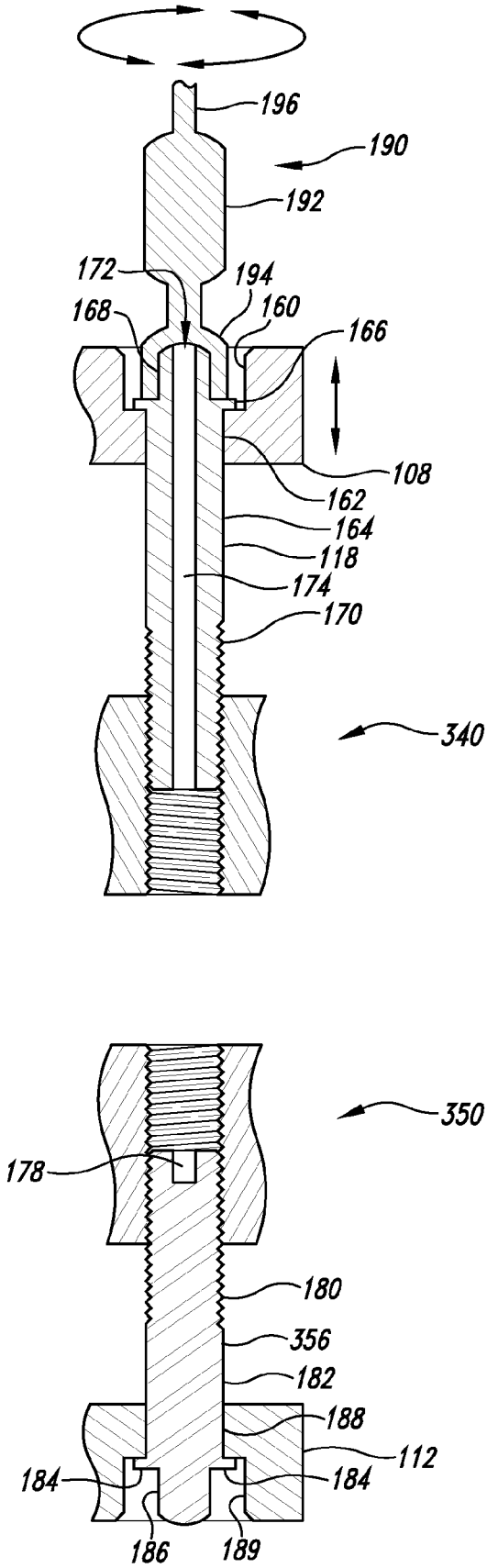
FIG. 20 is a cross-sectional side elevational view of the adjustment tool of FIG. 4 being used in an upper tuning position with the sixth tuning implementation of FIG. 19.
Figure 21:
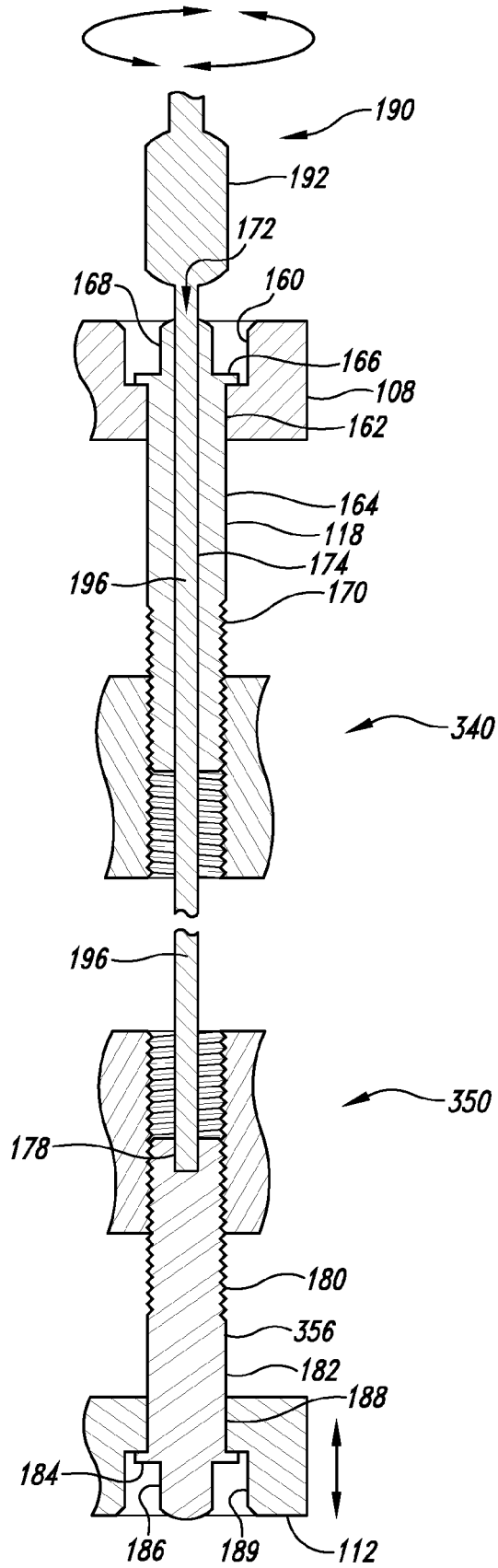
FIG. 21 is a cross-sectional side elevational view of the adjustment tool of FIG. 4 being used in a lower tuning position with the sixth tuning implementation of FIG. 19.

The lower tuning bolt 356 is similar in shape to the lower tuning bolt 120 of the first tuning implementation. The lower tuning bolt 356, however, is shorter than the lower tuning bolt 120 due to the addition of the lower support connectors 350 with the sixth tuning implementation. A version of the tool 190, shown in FIGS. 20 and 21, can be used with the sixth tuning implementation. However, the bore engaging portion 196 tends to be longer for the sixth tuning implementation compared with the first tuning implementation due to the increased distance of the lower bore portion from access at the head 168 of the upper tuning bolt 118 as depicted in particular in FIG. 21.

Figure 22:
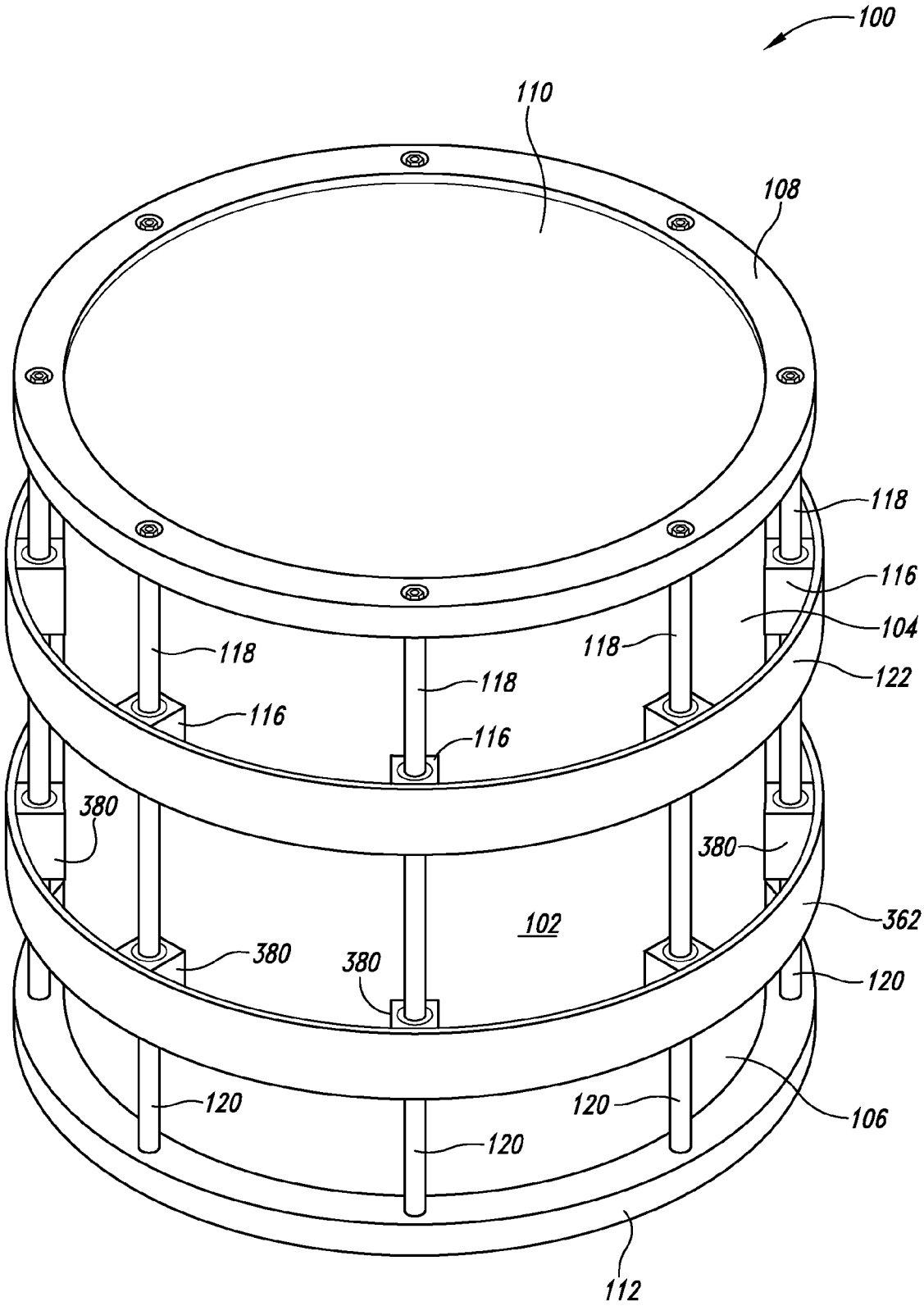
FIG. 22 is a perspective view of a drum having the sixth tuning implementation with a guide tube.
Figure 23:
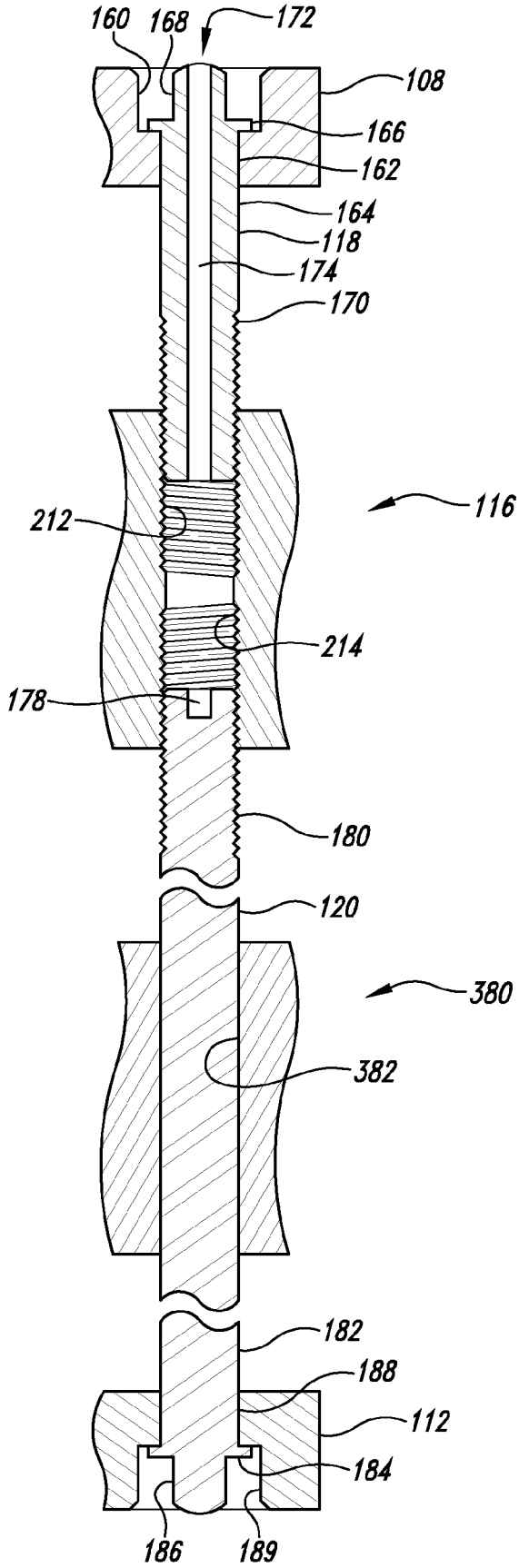
FIG. 23 is a cross-sectional side elevational view of a sectional portion of the drum of FIG. 22 showing detail of the sixth tuning implementation with the guide tube.

A version of the first tuning implementation is shown in FIGS. 22 and 23 with lower support connectors 380 providing points of attachment for the lower circumferential brace 362. As shown in FIG. 23, the lower support connector 380 has an opening 382 to allow the lower tuning bolt 120 to pass through the lower support connector without threadable engagement with the lower support connector. As described above for the first tuning implementation, the lower tuning bolt 120 threadably engages with the support connector 116.

Figure 24:
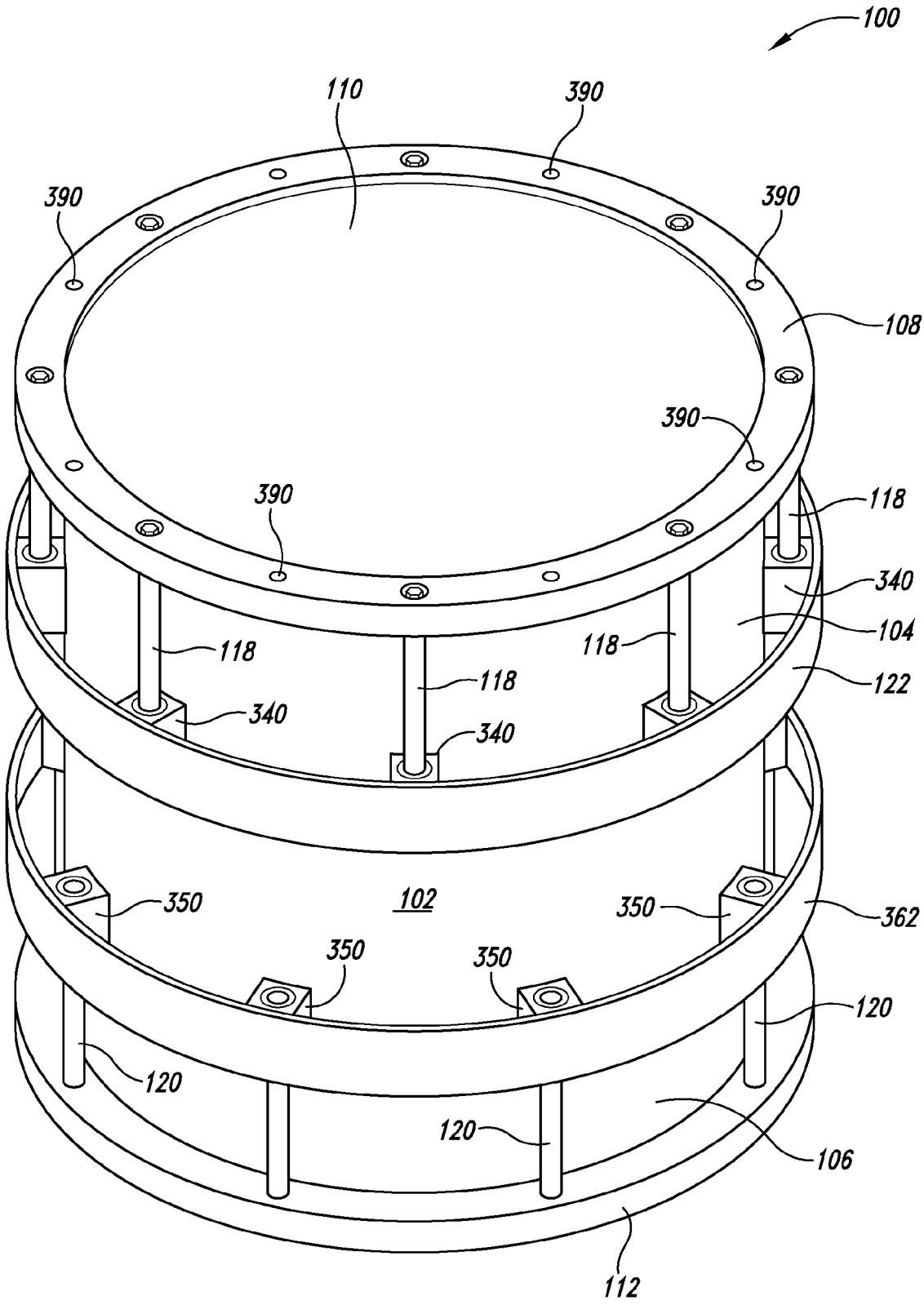
FIG. 24 is a perspective view of a drum having a seventh tuning implementation.
Figure 25:
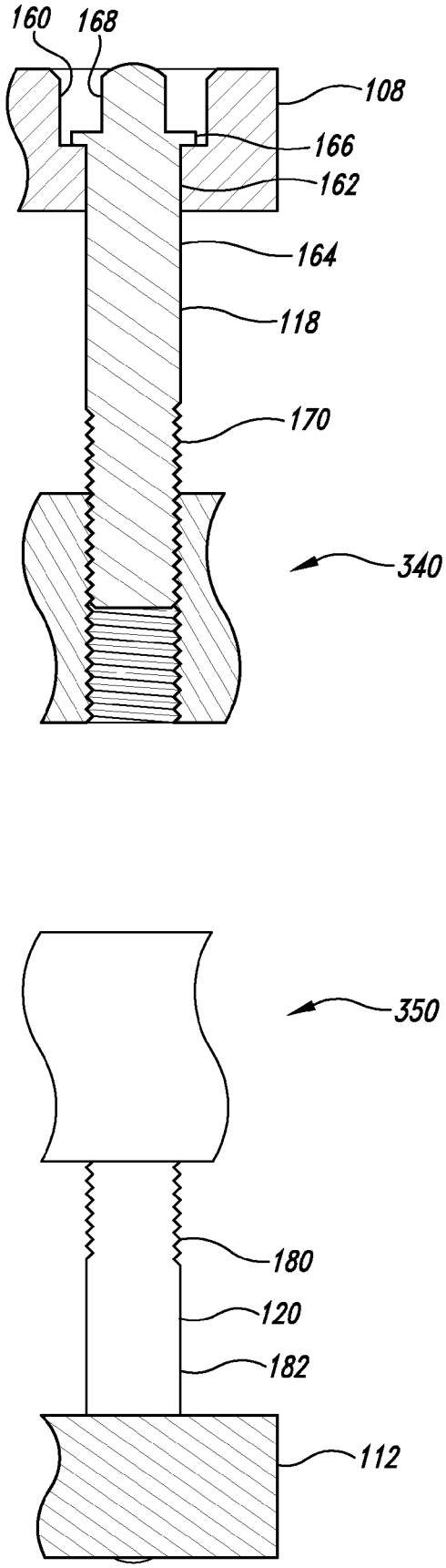
FIG. 25 is a cross-sectional side elevational view of a sectional portion of the drum of FIG. 18 showing upper detail of the seventh tuning implementation of FIG. 24.
Figure 26:
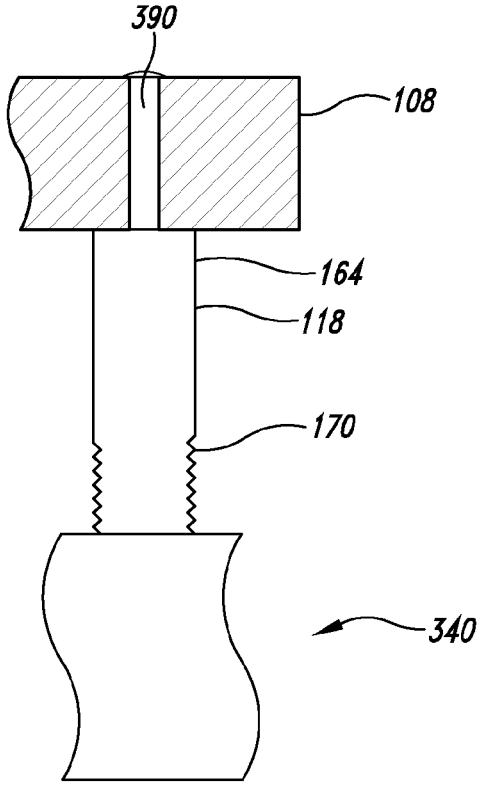
FIG. 26 is a cross-sectional side elevational view of a sectional portion of the drum of FIG. 18 showing lower detail of the seventh tuning implementation of FIG. 24.
Figure 26:
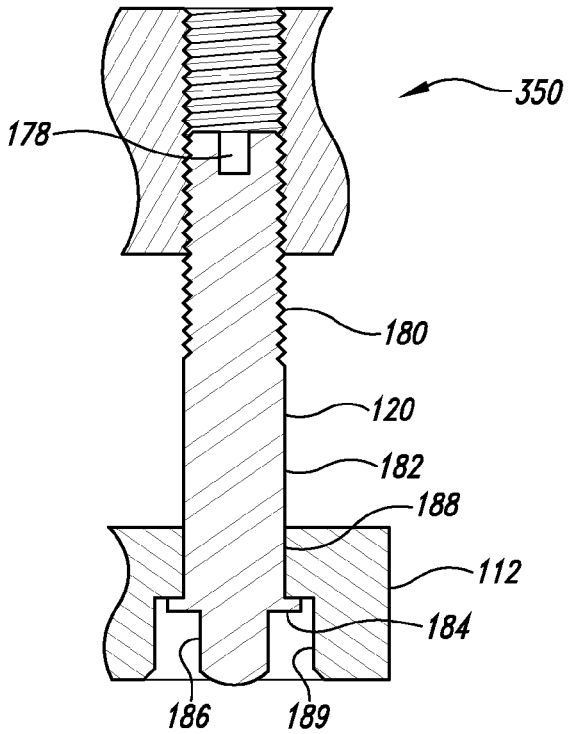

A seventh tuning implementation is shown in FIGS. 24-26 as having the upper support connectors 340 offset from the lower support connectors 350. A version of the upper rim 108 has a series of holes or passageways 390 to provide access for the bore engaging portion 196 of the adjustment tool 190 to the lower bore portion 178 of the shortened version of the lower tuning bolt 120.

Figure 27:
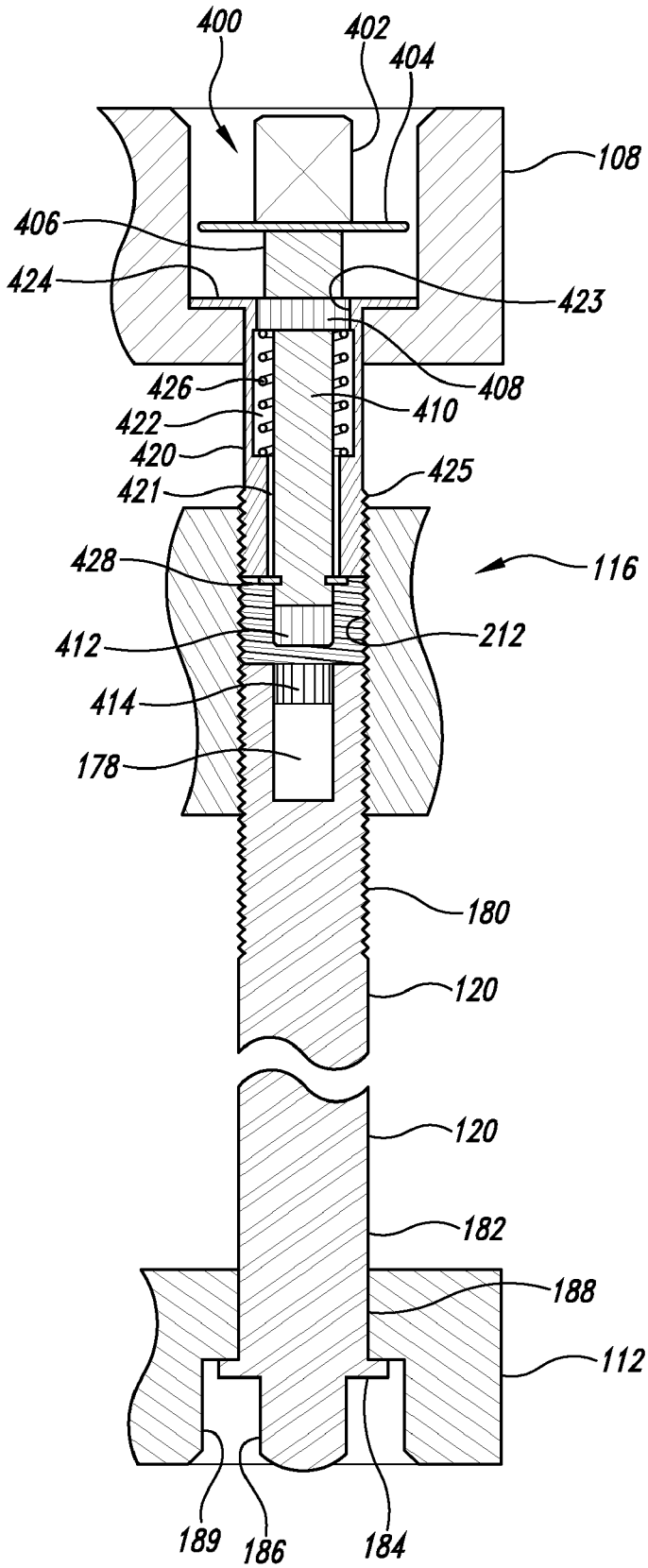
FIG. 27 is a cross-sectional side elevational view of a sectional portion of a drum showing detail of an eighth tuning implementation.
Figure 28:
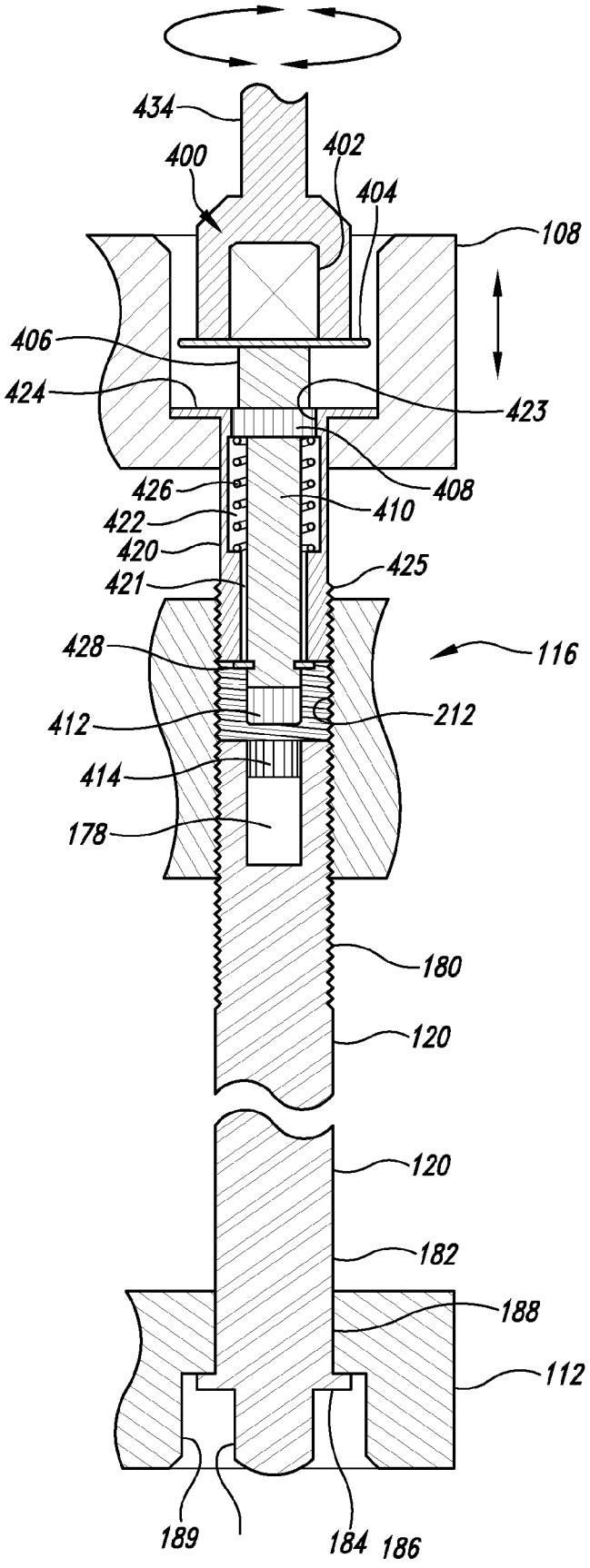
FIG. 28 is a cross-sectional side elevational view of FIG. 27 with a tuning tool being used in a top tuning position for tuning of the top drum head.
Figure 29:
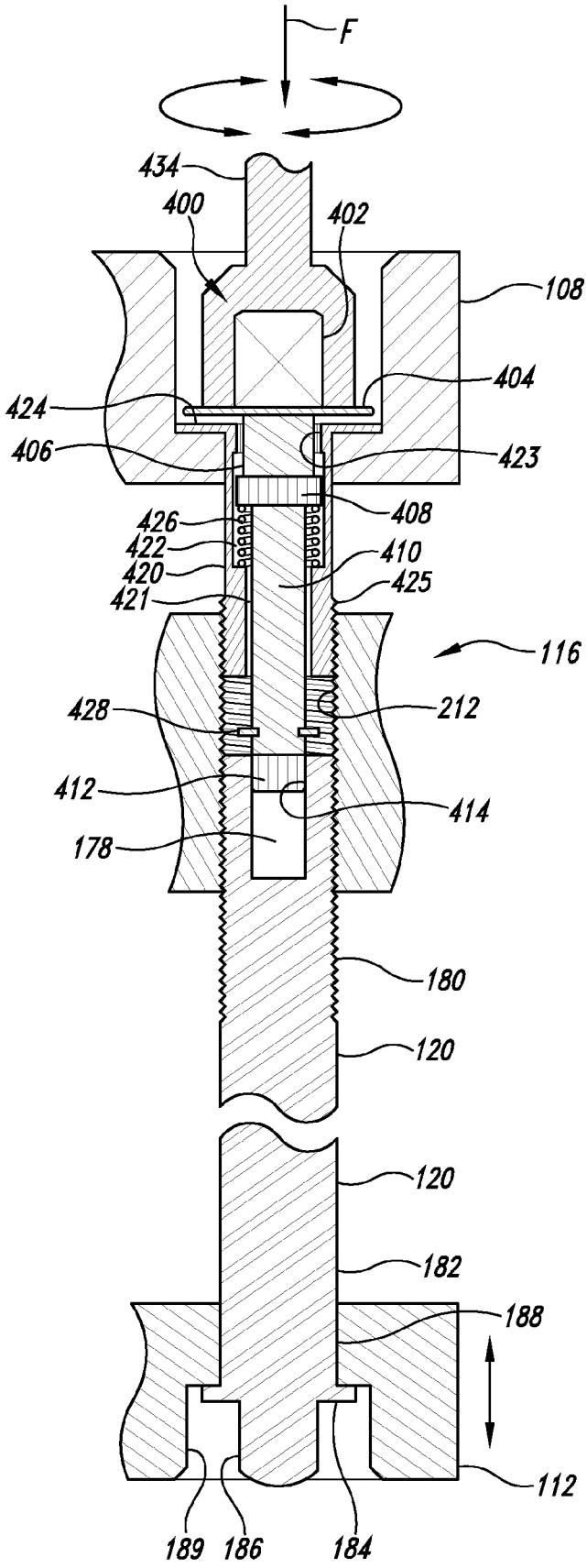
FIG. 29 is a cross-sectional side elevational view of FIG. 27 with the tuning tool being used in a bottom tuning position for tuning of the bottom drum head.
Figure 30:
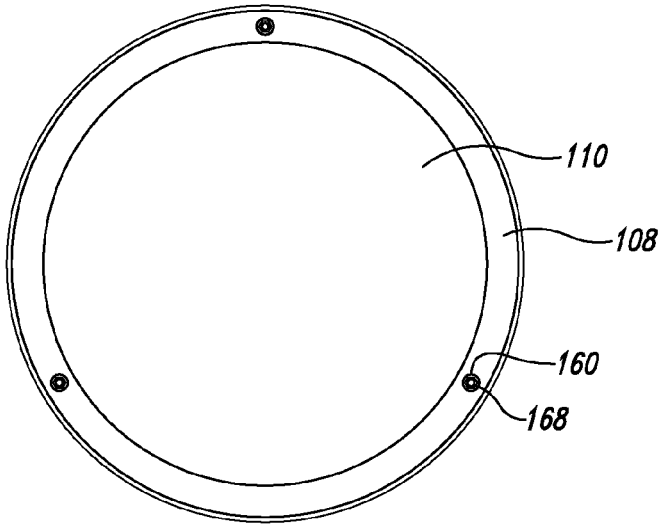
FIG. 30 is a top plan view of a drum with a three bolt pattern.
Figure 31:
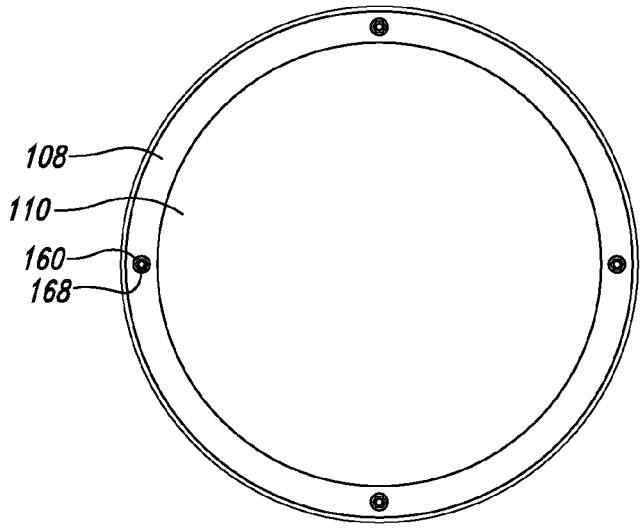
FIG. 31 is a top plan view of a drum with a four bolt pattern.
Figure 32:
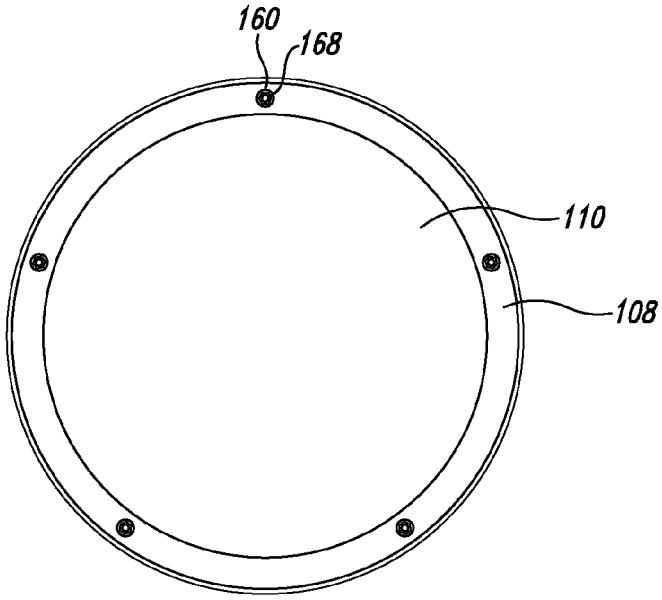
FIG. 32 is a top plan view of a drum with a five bolt pattern.
Figure 33:
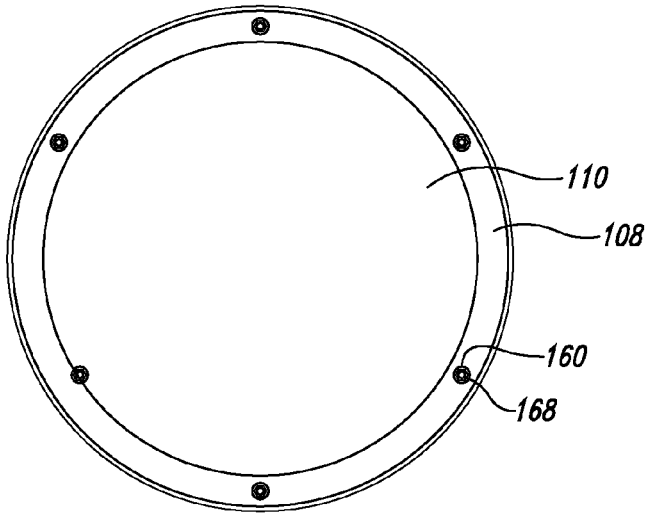
FIG. 33 is a top plan view of a drum with a six bolt pattern.
Figure 34:
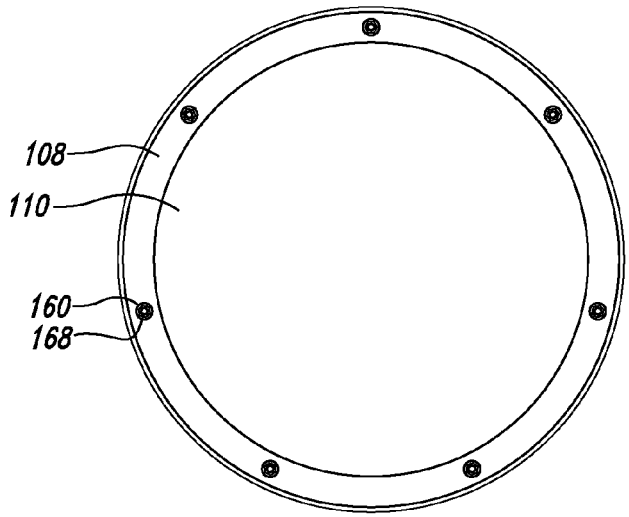
FIG. 34 is a top plan view of a drum with a seven bolt pattern.
Figure 35:
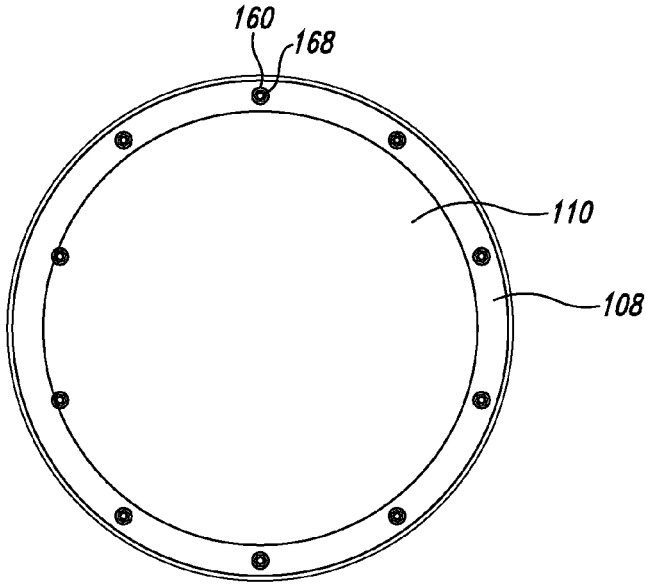
FIG. 35 is a top plan view of a drum with a ten bolt pattern.

An eighth tuning implementation is shown in FIGS. 27-29 as having an engagement pin 400 with a head 402, a flange 404, an upper shaft 406 with an upper key 408, and a lower shaft 410 with a lower key 412. The lower key 412 is shaped to mate with the lower bore portion 178 of a version of the lower tuning bolt 120 used for the eighth tuning implementation. For instance, the lower bore portion 178 could be formed with splined inner surface 414 as shown. The eighth tuning implementation furthermore includes an upper tuning bolt 420 having a bore 421 with an interior space 422, and an upper spline portion 423 at an upper end of the bore to receive the upper key 408 of the adjustment pin 400. The upper tuning bolt 420 has a flange 424 that applies force to the upper rim 108 and a threaded section 425 that engages with various versions of the support connector 116.

Located in the interior space 422, a spring 426 applies upward force on the upper key 408 of the engagement pin 400. A clip 428 is coupled to the engagement pin 400 to retain the engagement pin 400 in the bore 421 of the upper tuning bolt 420.

If little or no downward force is applied by a tool 434 (depicted as a socket wrench, but in other versions dependent upon the version of the head 402 of the engagement pin 400), the engagement pin 400 will be located in a first vertical position as shown in FIG. 28. In the first vertical position, the upper key 408 of the engagement pin 400 will be engaged with the upper spline portion 423 of the upper tuning bolt 420 to be able to rotate the upper tuning bolt and thereby adjust tension applied to the upper rim 108 and tune the upper head 110. In the first vertical position, the lower key 412 of the engagement pin 400 is not engaged with the lower bore portion 178 of the lower tuning bolt 120.

If a downward force, F, is applied by the tool 434 to the engagement pin 400 that is great enough to overcome the upward force from the spring 426, the engagement pin will be located in a second vertical position as shown in FIG. 29. In the second vertical position, the upper key 408 of the engagement pin 400 is not engaged with the upper spline portion 423 of the upper tuning bolt 420. In the second vertical position, the lower key 412 of the engagement pin 400 is engaged with the lower bore portion 178 of the lower tuning bolt 120 to be able to rotate the lower tuning bolt and thereby adjust tension applied to the lower rim 112 and tune the lower head 114.

Exemplary depictions of three, four, five, six, seven, and ten bolt patterns are shown in FIGS. 31-35, respectively, for coupling with the upper rim 108 and the lower rim 112. Other bolt patterns could also be used in other implementations as appropriate.

Figure 36:
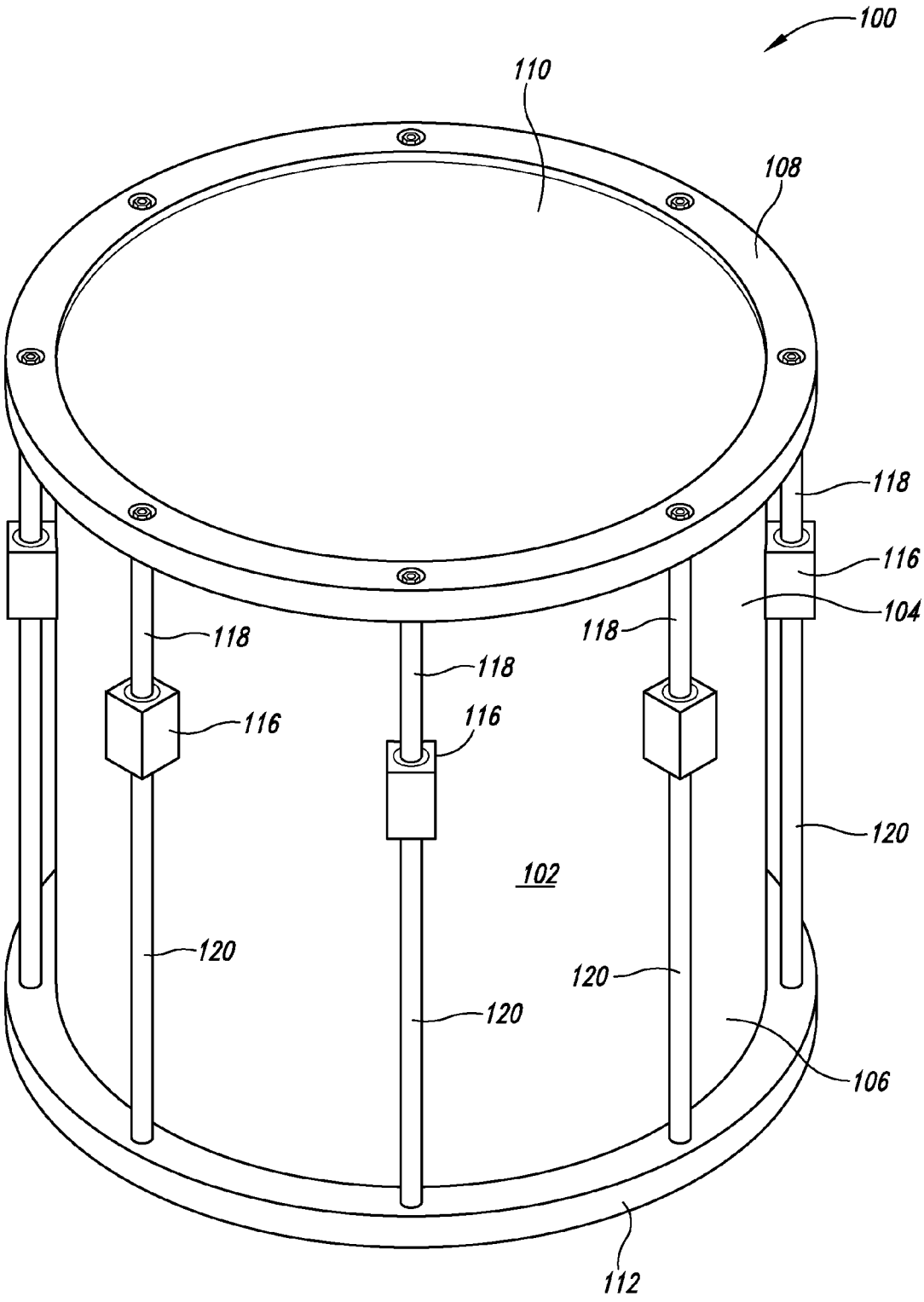
FIG. 36 is a perspective view of a drum with the first tuning implementation of FIG. 2 without circumferential bracing.
Figure 37:
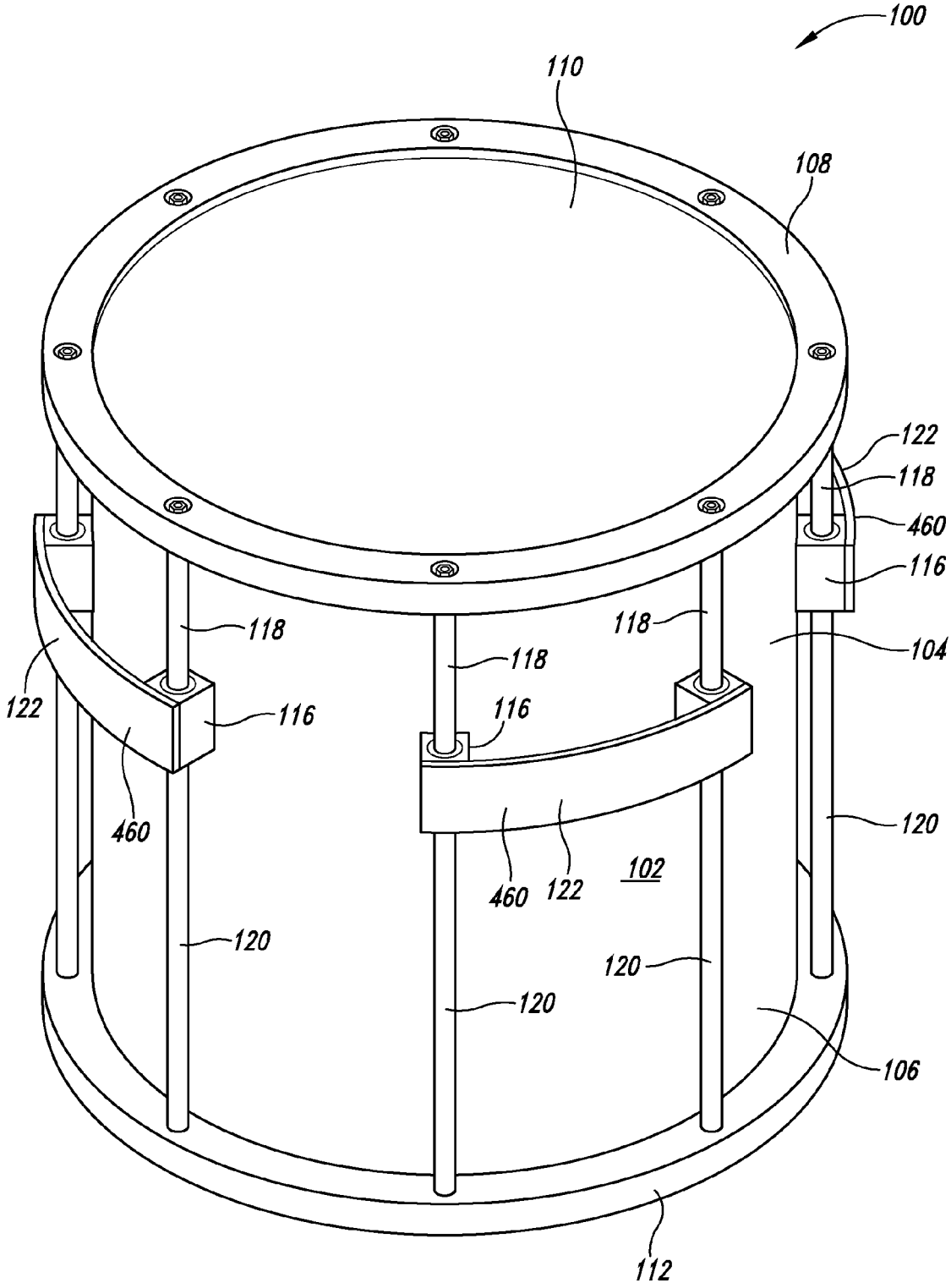
FIG. 37 is a perspective view of a drum with the first tuning implementation of FIG. 2 and with a second circumferential bracing implementation.

As shown in FIG. 36, a version of the first attachment implementation need not include the peripheral brace 122. In another version of the first attachment implementation, partial sections 460 of the peripheral brace 122 are shown in FIG. 37 for a second peripheral bracing implementation with each partial section spanning between only two of the coupling connectors 116. In other implementations, other combinations of the partial sections 460 may be used, for instance, such that more than two of the coupling connectors 116 are spanned by a single partial section.

Figure 38:
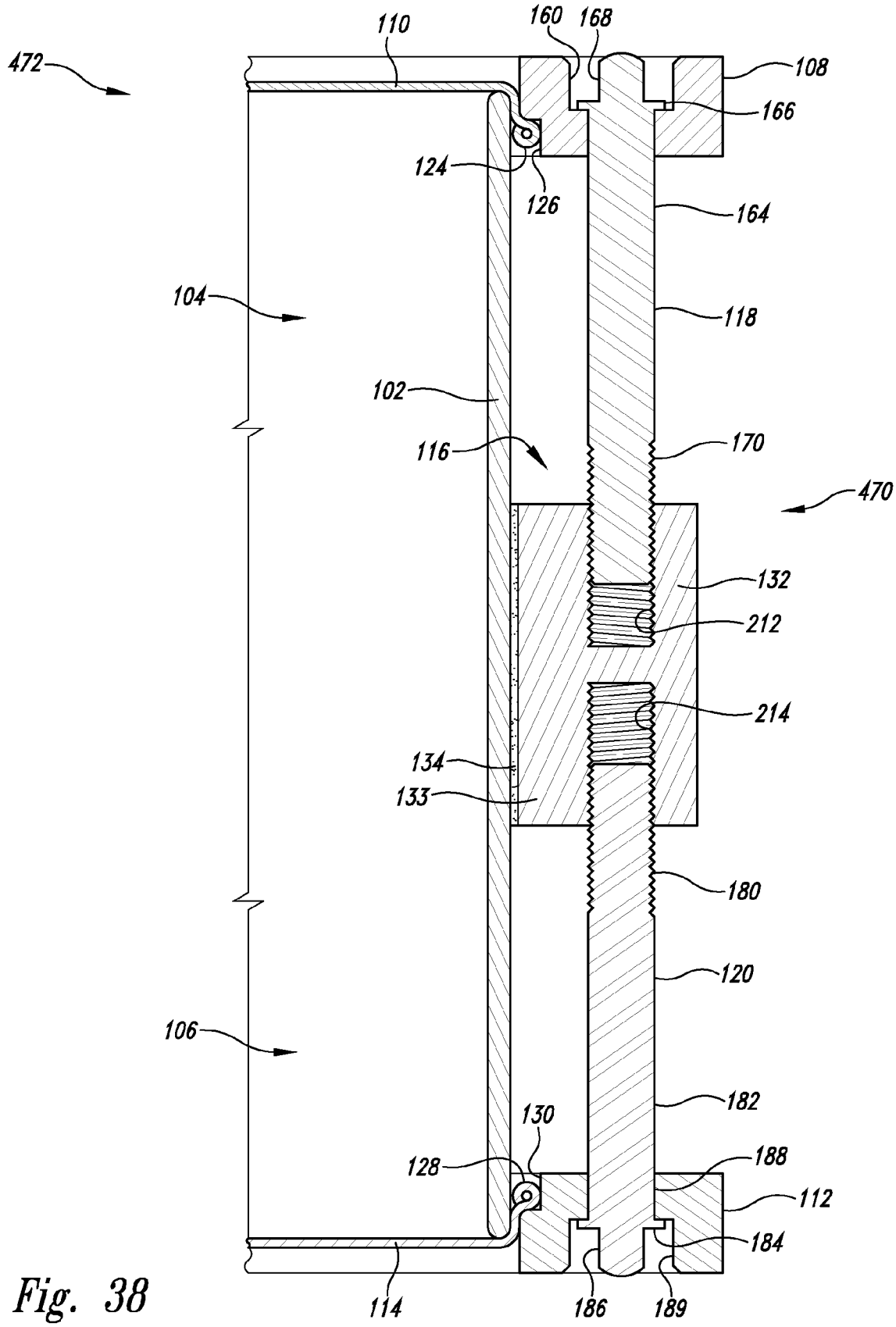
FIG. 38 is a cross-sectional side elevational view of a sectional portion of a drum with a conventional tuning implementation and the first attachment implementation.

As shown in FIG. 38, conventional tuning hardware 470 can be affixed to a drum 472 using the bonding material 134 of the first attachment implementation.

Figure 39:
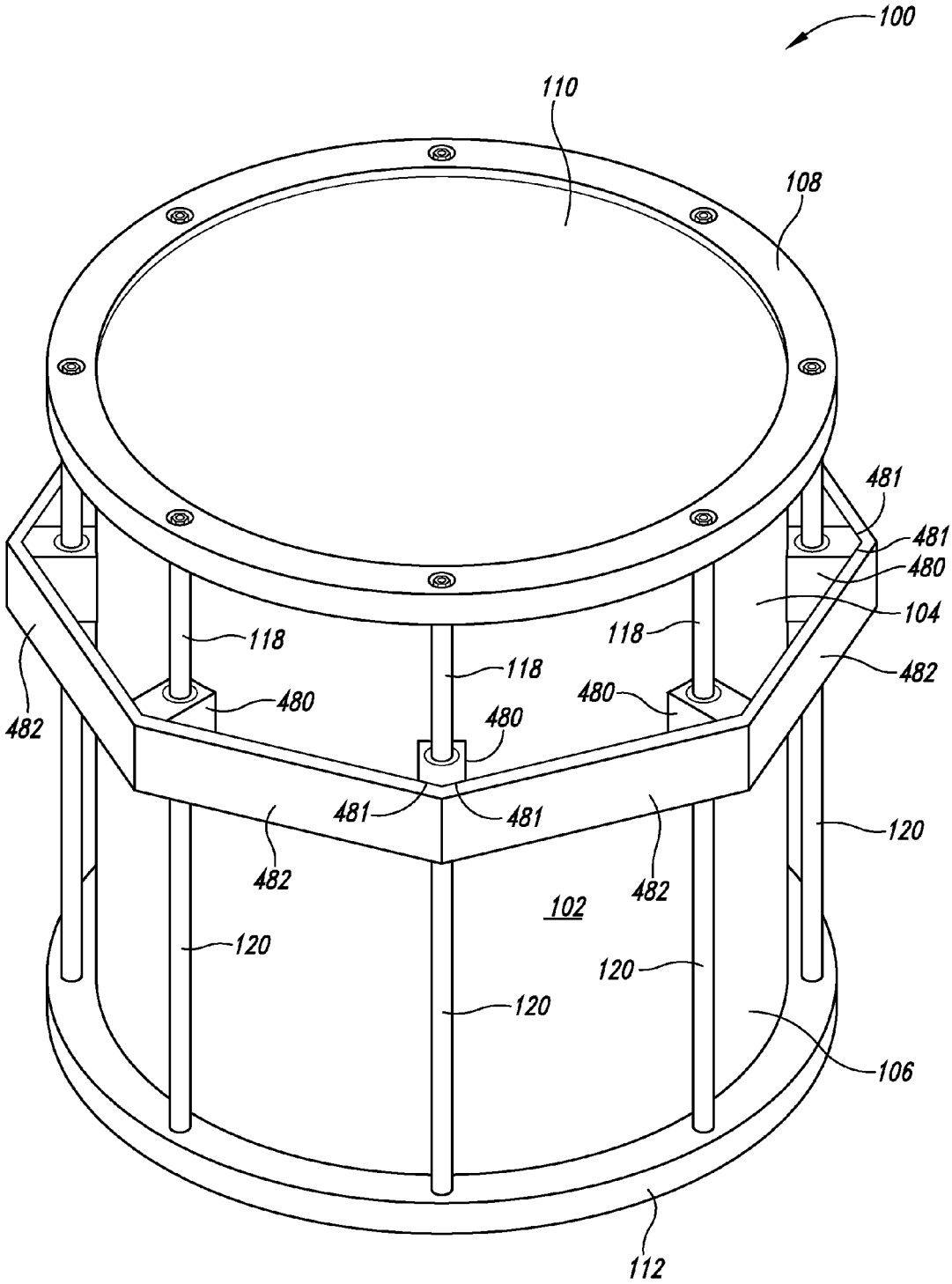
FIG. 39 is a perspective view of a drum with a third circumferential bracing implementation.
Figure 40:
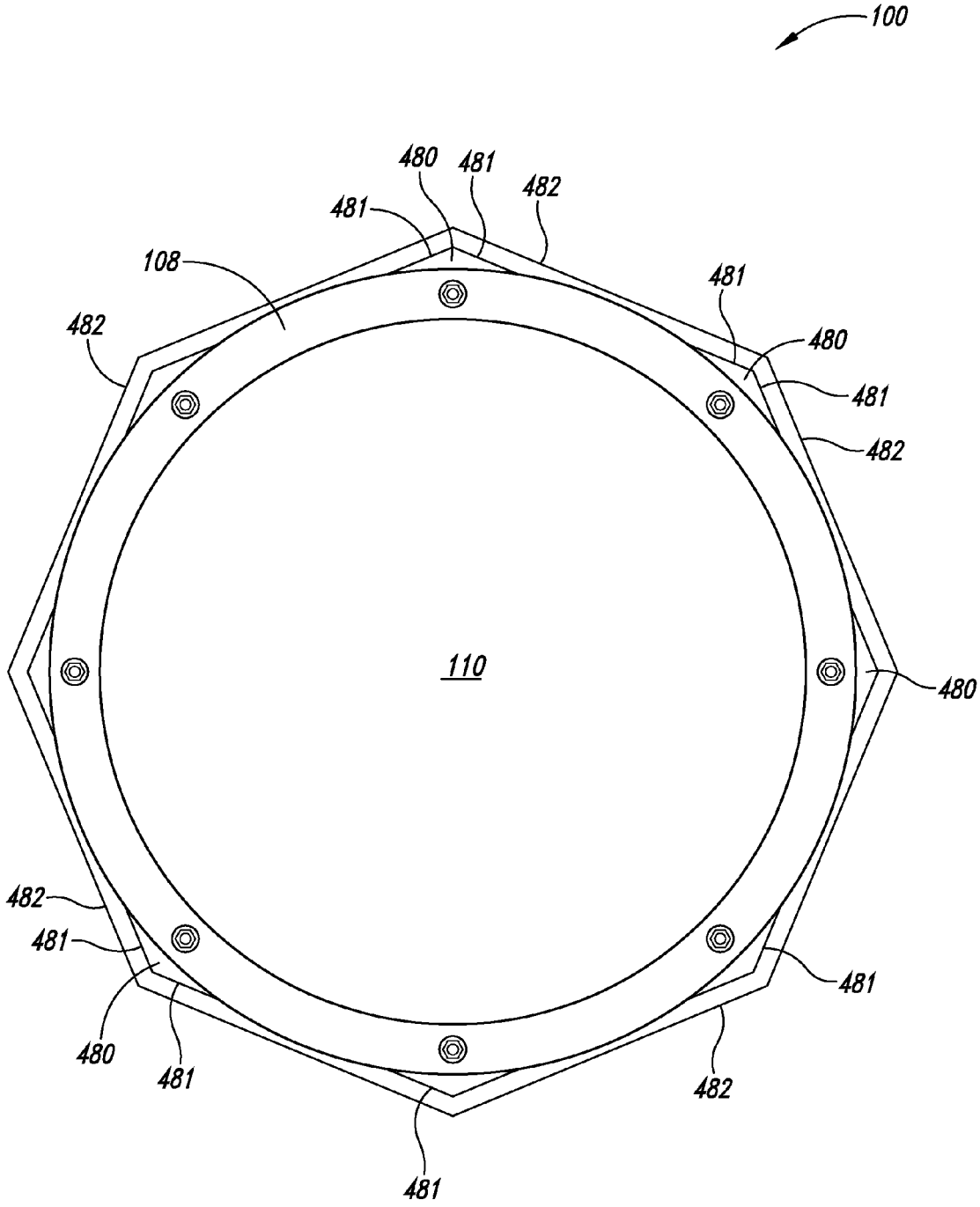
FIG. 40 is a top plan view of the drum of FIG. 39.

A third peripheral bracing implementation is shown in FIG. 39 as having support connectors 480 with angled exterior surfaces 481 that flat surfaced peripheral braces 482 can be affixed thereto.

Figure 41:
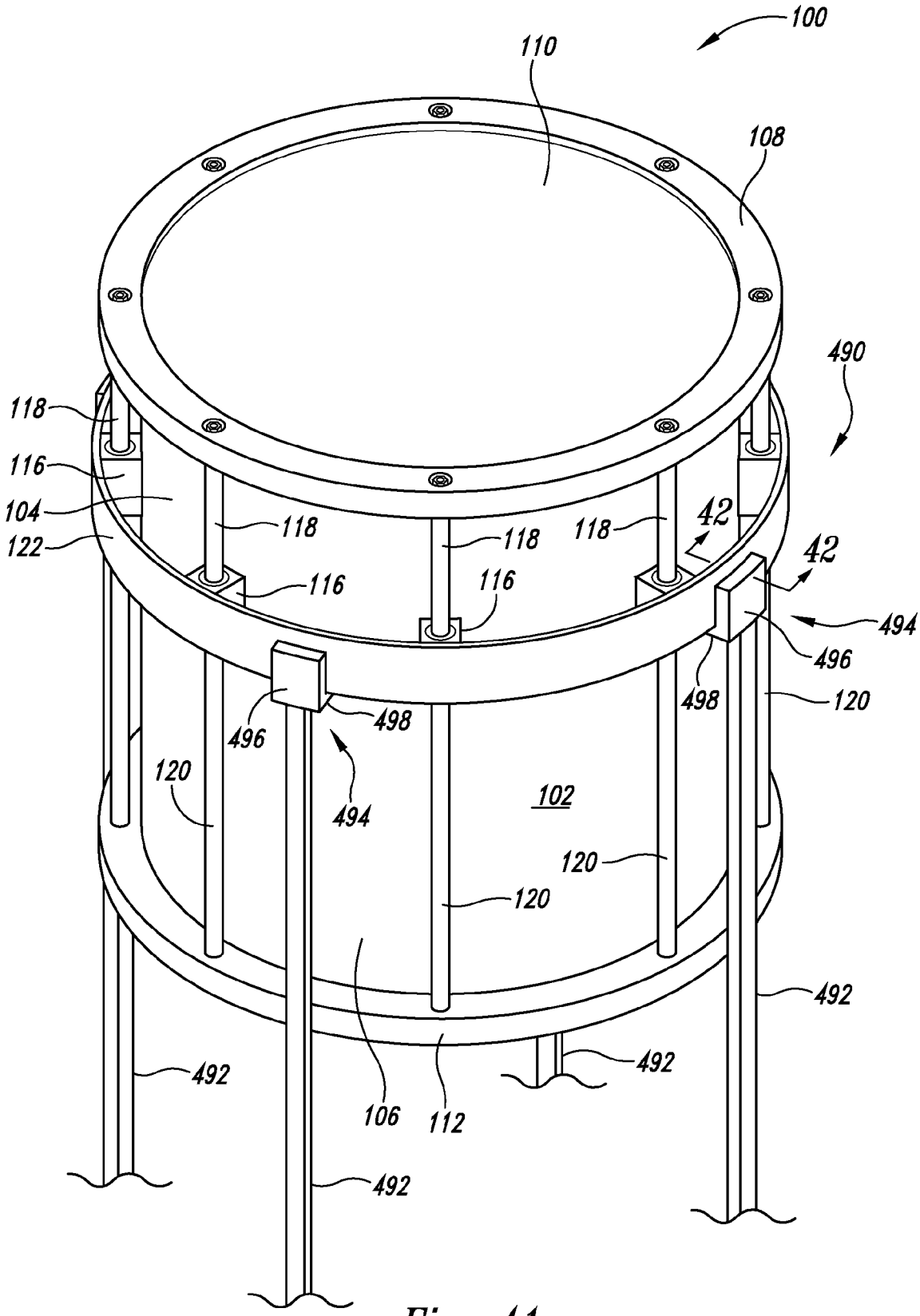
FIG. 41 is a perspective view of the drum of FIG. 1 showing a stand implementation.
Figure 42:
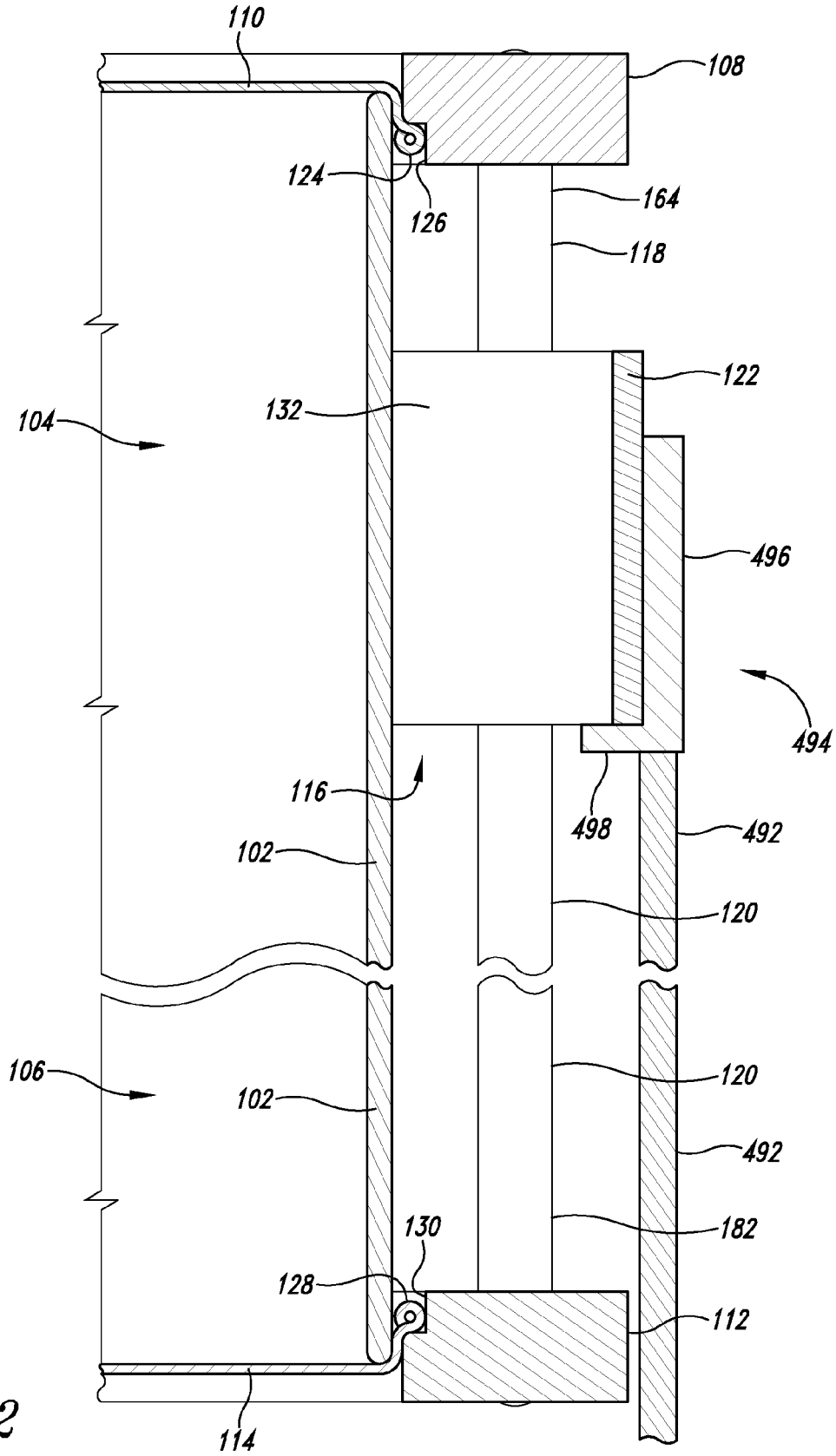
FIG. 42 is a cross-sectional side elevational view of a sectional portion of the drum of FIG. 41 showing detail of the stand implementation.

A drum stand 490 is shown in FIGS. 41 and 42 as having a plurality of leg members 492 each of which is affixed to a bracket 494 that has a side wall 496 and a shelf 498. The drum stand 490 supports the drum 100 by having portions of the peripheral brace 122 rest upon the shelf 498 of each of the brackets 494. The side wall 496 of each of the brackets 494 is used to help position the drum 100 on the drum stand 490.

Figure 43:
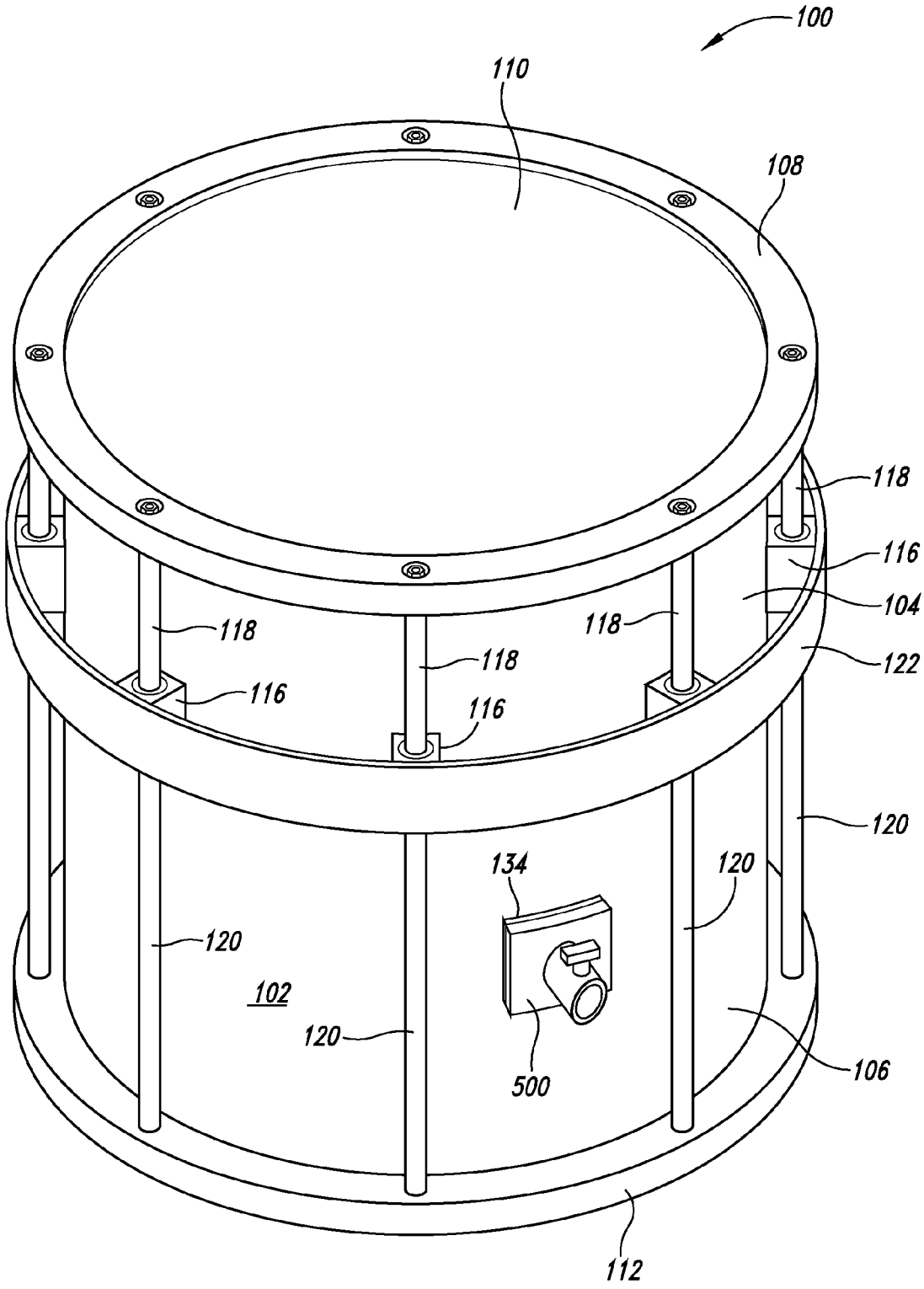
FIG. 43 is a perspective view of a drum having the first tuning implementation of FIG. 1 and a drum kit coupler affixed to the drum.
Figure 44:
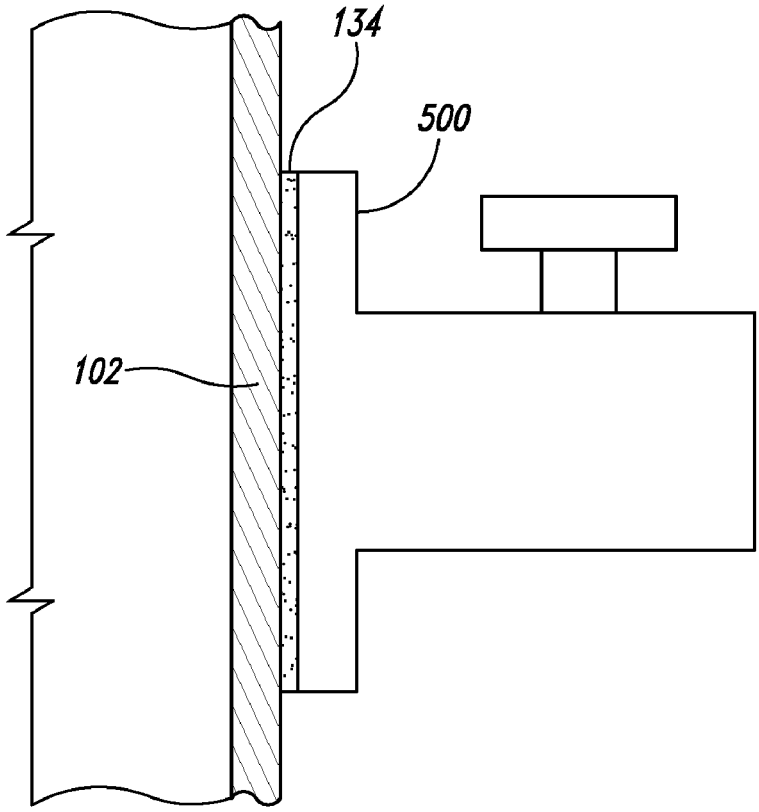
FIG. 44 is a cross-sectional side elevational view of a sectional portion of the drum of FIG. 43 showing detail of the coupler affixed to the drum by the first attachment implementation.

A bracket 500 for mounting the drum 100 to a conventional drum kit is shown in FIGS. 43 and 44 as affixed to the shell 102 of the drum with the bonding material 134 of the first attachment implementation. Use of the bonding material 134 allows the bracket 500 to be affixed to the drum 100 without the need for penetration of the shell 102 of the drum by conventional fastening hardware.

Figure 45:
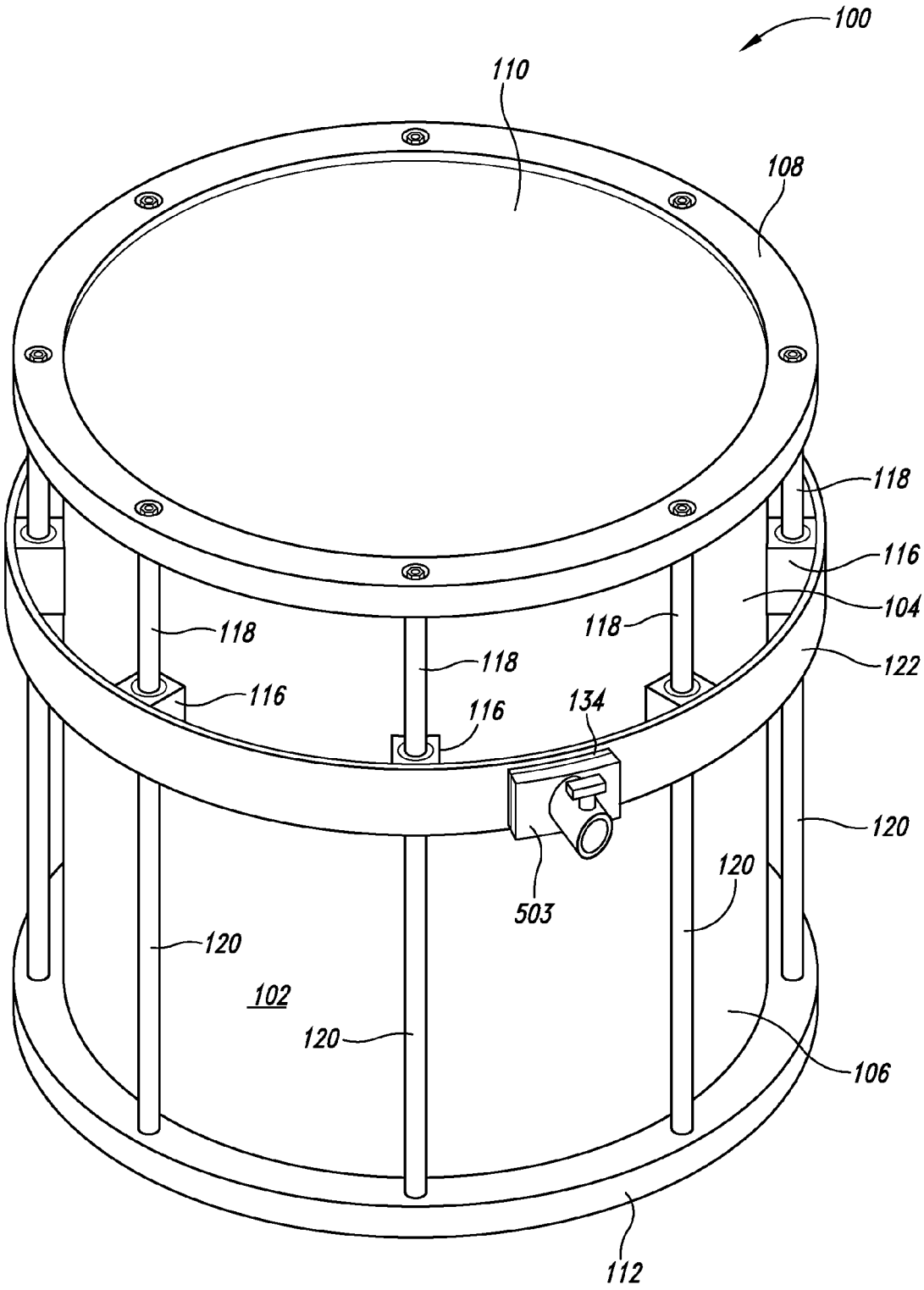
FIG. 45 is a perspective view of a drum having the first tuning implementation and attachment implementation of FIG. 1 and a drum kit coupler affixed to the circumferential bracing of the drum.
Figure 46:
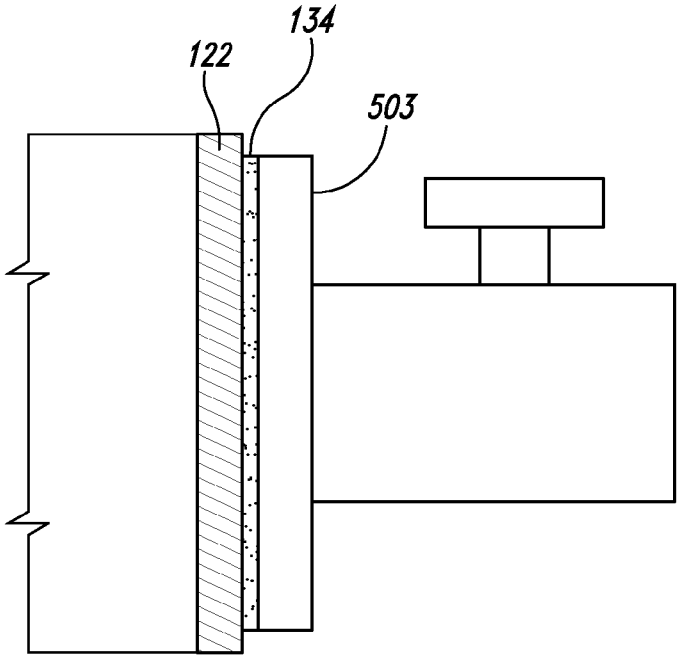
FIG. 46 is a cross-sectional side elevational view of a sectional portion of the drum of FIG. 45 showing detail of the coupler affixed to the circumferential bracing of the drum by the first attachment implementation.
Figure 47:
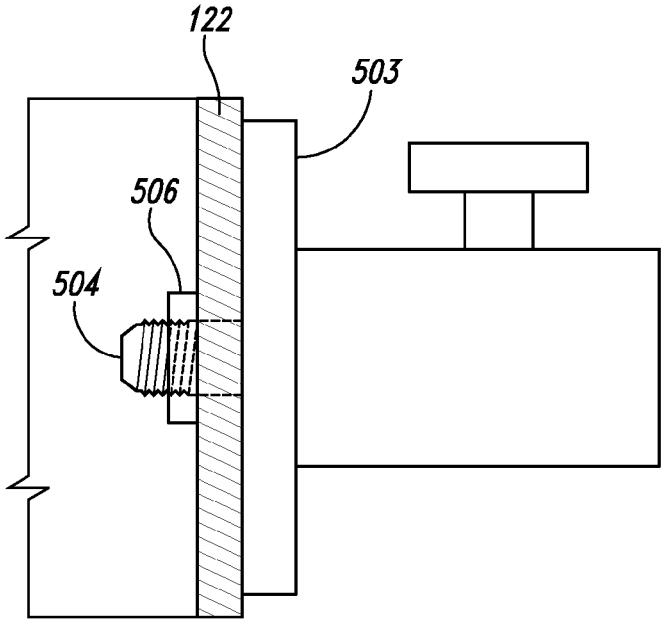
FIG. 47 is a cross-sectional side elevational view of a sectional portion of the drum of FIG. 45 showing detail of the coupler affixed to the circumferential bracing of the drum by a third attachment implementation.
Figure 48:
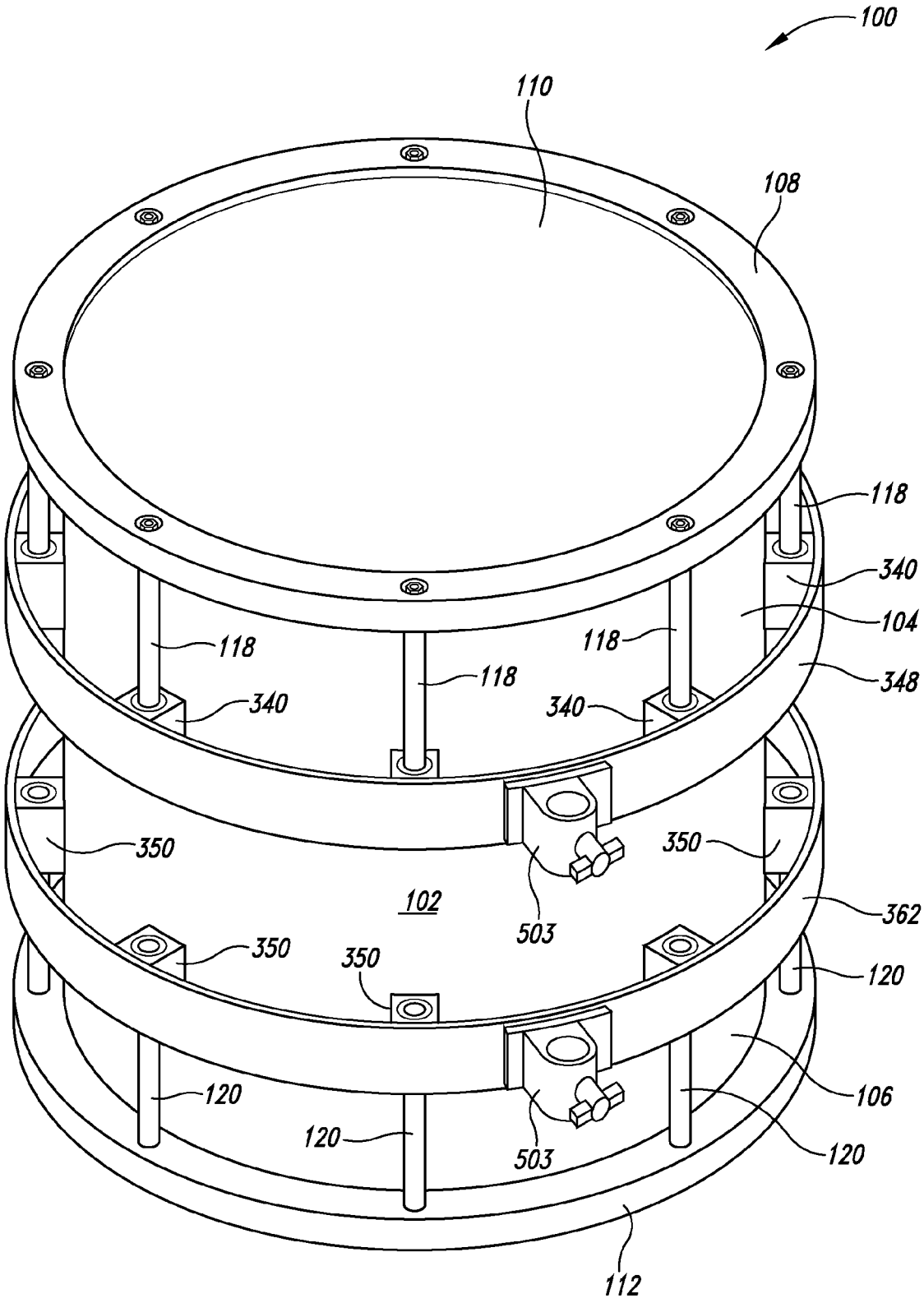
FIG. 48 is a perspective view of the drum of FIG. 18 and an upper drum kit coupler affixed to the upper circumferential bracing of the drum and a lower drum kit coupler affixed to the lower circumferential bracing of the drum.

A bracket 503 for mounting the drum 100 to a conventional drum kit is shown in FIGS. 45-47 as affixed to the peripheral brace 122. In FIG. 46, the bracket 503 is shown affixed to the peripheral brace 122 by the bonding material 134 of the first attachment implementation. In FIG. 47, the bracket 503 is shown affixed to the peripheral brace 122 by a bolt 504 and nut 506, but other such mounting hardware could be used. Since the bracket 503 is affixed to the peripheral brace 122 either through the first attachment implementation or through mounting hardware, the shell 102 of the drum 100 need not be penetrated to affix the bracket to the drum. As depicted in FIG. 48, one of the brackets 503 can be affixed to each of the upper peripheral brace 348 and the lower peripheral brace 362 of the drum 100 of the sixth tuning implementation.

Figure 49:
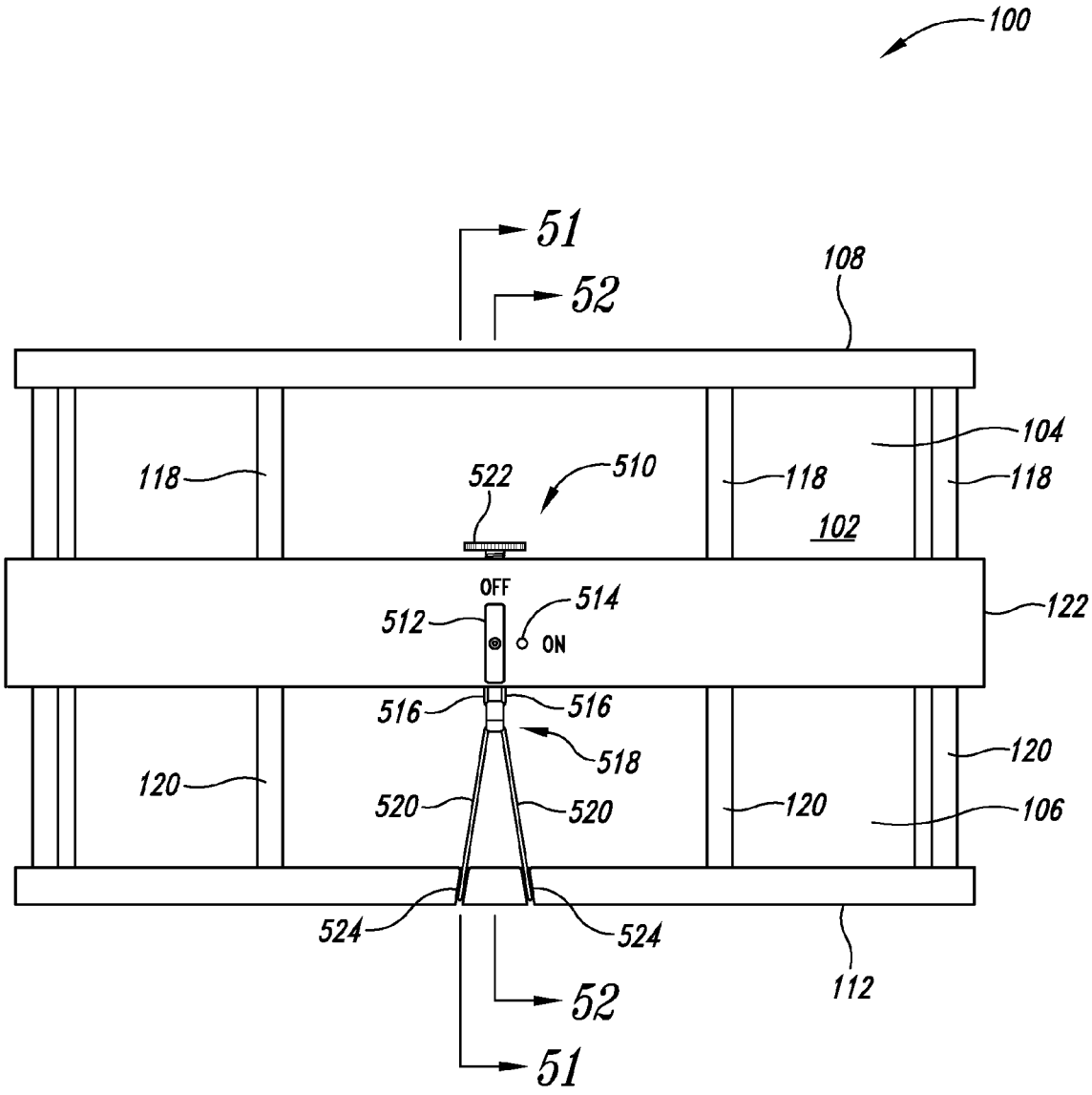
FIG. 49 is a side elevational view of a drum showing an exterior side of a strainer implementation in an "off" position and attached to the circumferential bracing of the drum.
Figure 50:
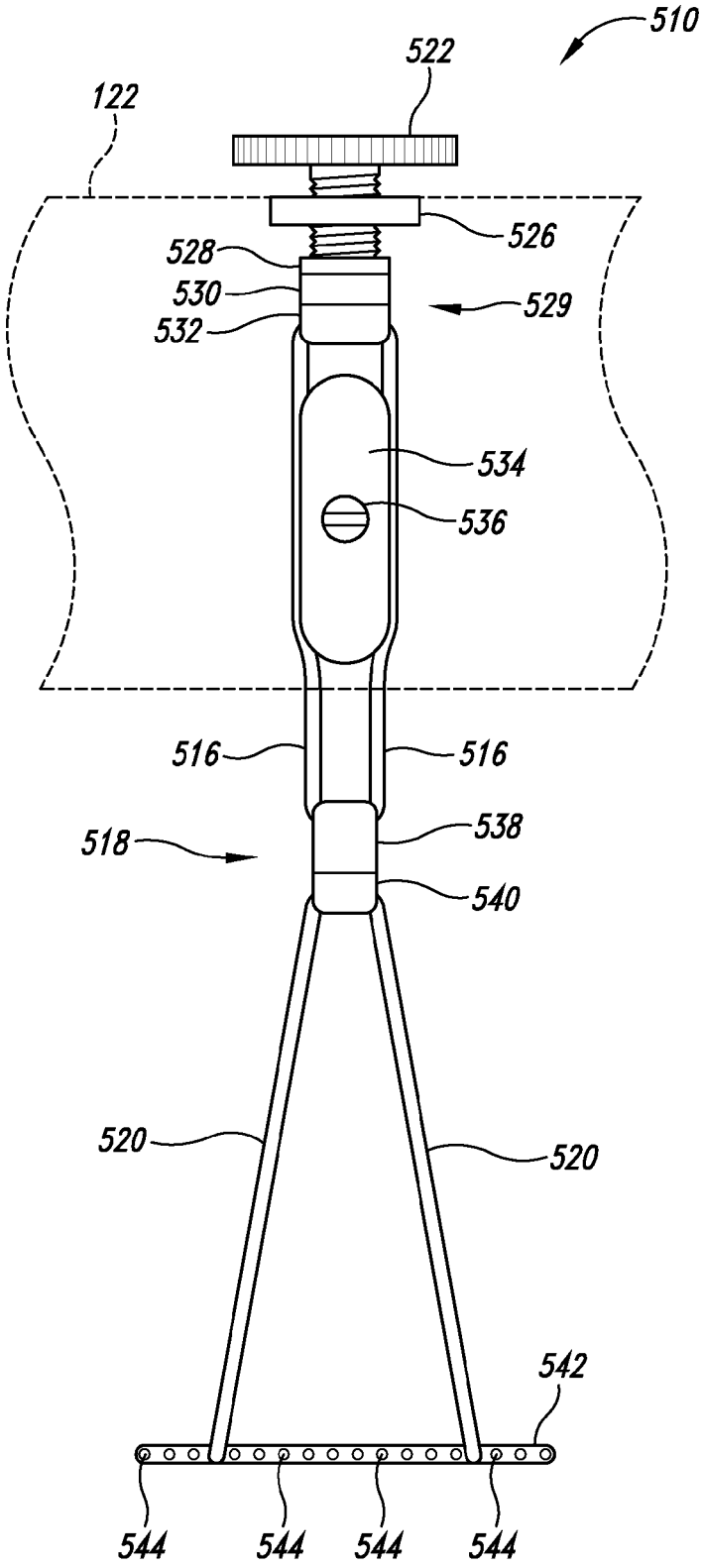
FIG. 50 is a side elevational view showing the interior side of the strainer implementation in the "off" position and attached to the circumferential bracing of the drum.

A strainer assembly 510 for a snare drum implementation is shown in FIG. 49 as mounted to the circumferential brace 122. The strainer assembly 510 has a control lever 512, a ball 514 to secure positioning of the control lever (by preferably engaging with a small indented surface portion of the control lever), an upper cord 516, a lower connector 518, a lower cord 520, and a fine tune screw 522. To accommodate the strainer assembly 510, the lower rim 112 has cord guides 524 to help position the lower cord 520. The strainer assembly 510 further has a threaded screw retainer 526, as shown in FIG. 50, a locking nut 528, an upper connector 529, a screw coupler 530, a cord coupler 532, and a spreader 534 with a bolt 536. The connector 518 includes an upper coupler 538 and a lower coupler 540. The lower cord 520 is coupled to a conventional cross bar 542, which is used to retain conventional snare wires 544.

Figure 51:
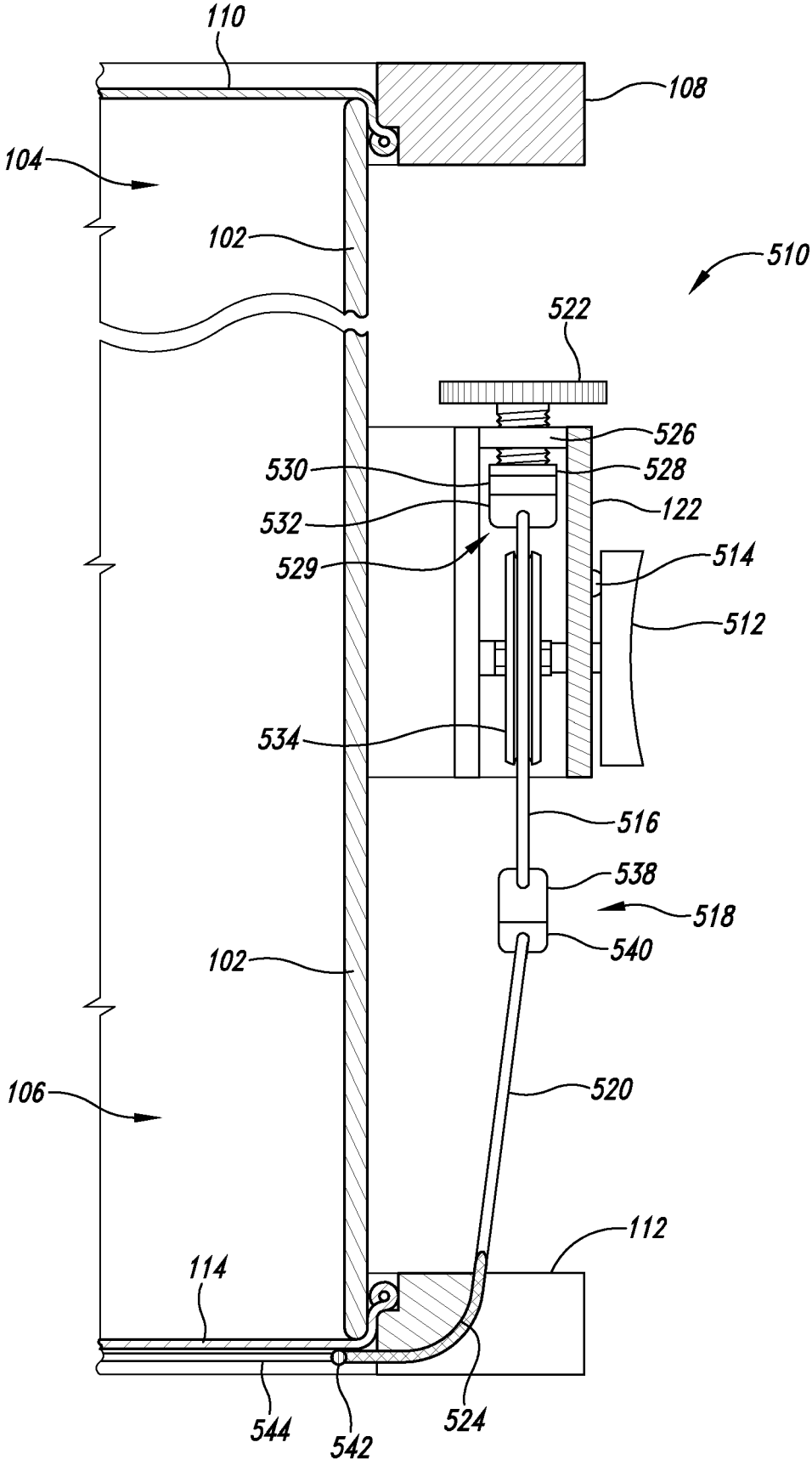
FIG. 51 is a side elevational view of a drum showing an exterior side of a strainer implementation in an "on" position and attached to the circumferential bracing of the drum.
Figure 52:
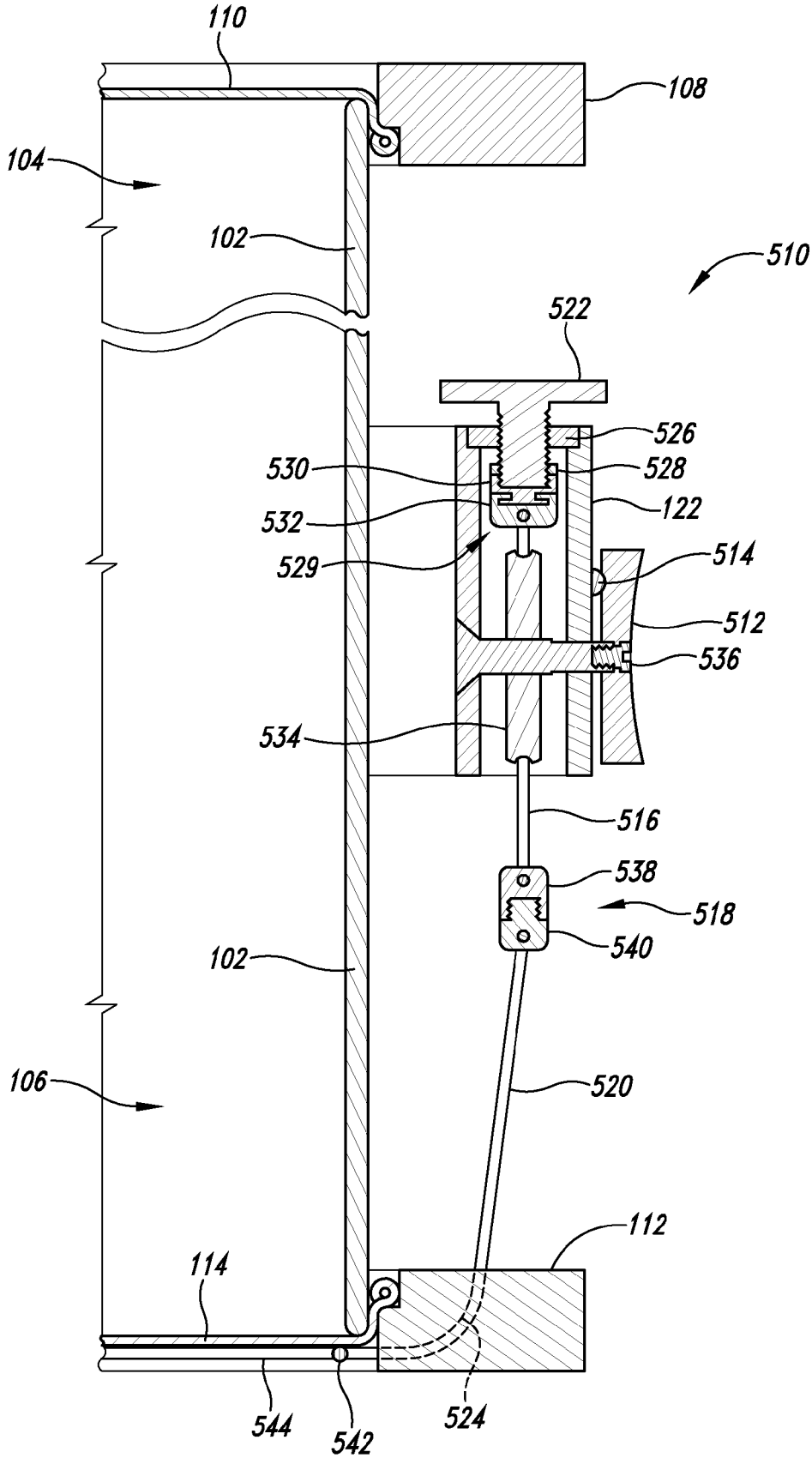
FIG. 52 is a side elevational view showing the interior side of the strainer implementation in the "on" position and attached to the circumferential bracing of the drum.

When the control lever 512 is vertically oriented as shown in FIG. 49, the spreader 534 is also vertically oriented as shown in FIGS. 50-52. While the spreader 534 is vertically oriented, the upper cord 516 is in a slackened state allowing for the vertical elevation of the connector 518 to be at its lowest possible position for a given position of the fine tune screw 522. At this lowest position of the connector 518, the lower cord 520 is positioned to allow the cross bar 542 to be positioned so that the snare wires 544 are in a slackened state effectively causing the drum 100 to act as a tom rather than a snare drum. The fine tune screw 522 is threadably engaged with the screw coupler 530 of the upper connector 529 and can be used to adjust the vertical elevation of the lower connector 518 to put further slack or tension on the snare wires 544 if needed when the spreader 534 is vertically oriented.

Some versions of the lower connector 518 have a quick release capability using bayonet style, jewelry style or other sorts of connections between the upper coupler 538 and the lower coupler 540. With the quick release capability, the upper coupler 538 can be readily separated from and rejoined to the lower coupler 540 to provide access to the lower head 114 for replacement or other reasons. Access to the lower head 114 can thus be provided without having to sever the lower cord 520. When the snares wires 544 need replacement, the lower cord 520 can be replaced as well by severing the lower cord without dismantling other components of the strainer assembly 510.

Figure 53:
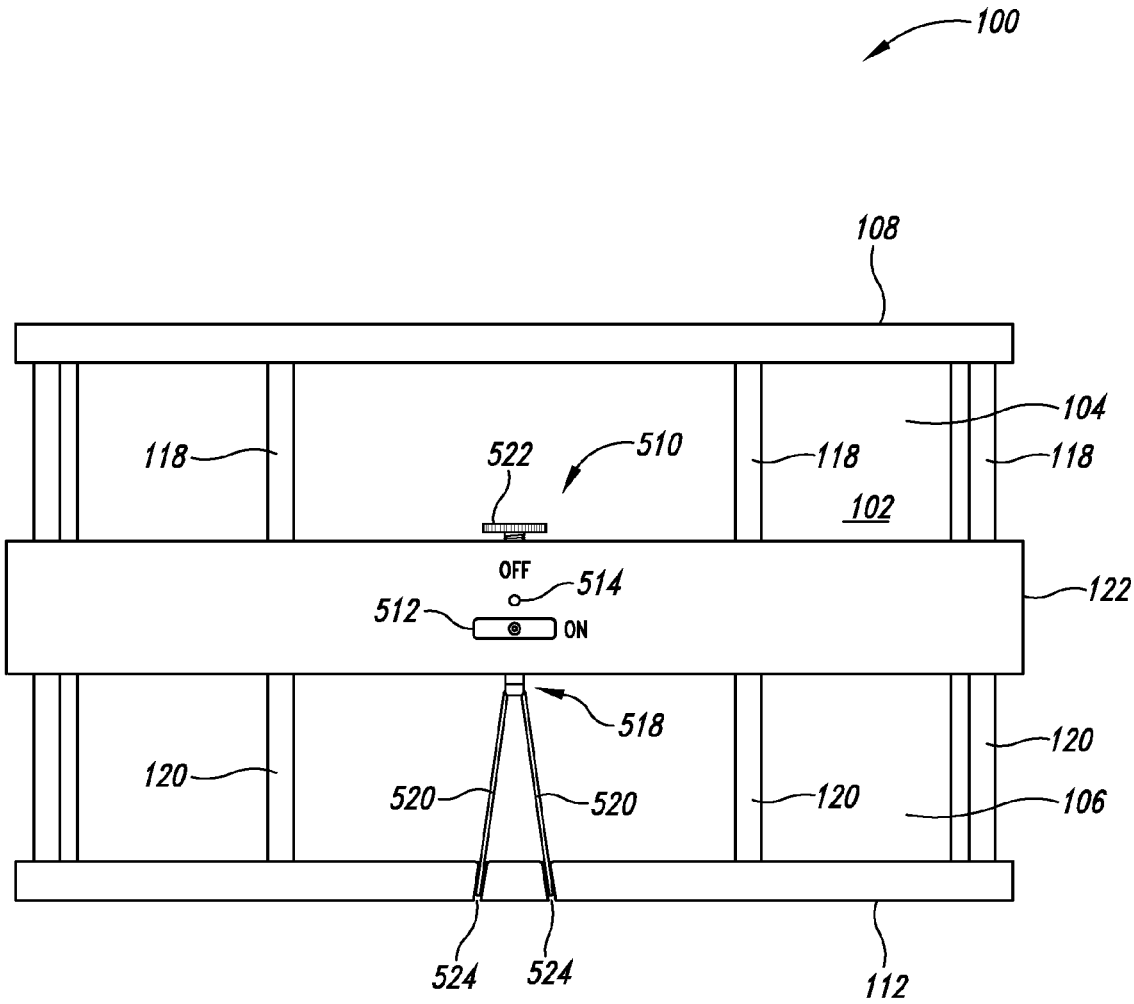
FIG. 53 is a side elevational cross-sectional view of the strainer implementation in the "off" position taken along the 53-53 line of FIG. 49.
Figure 54:
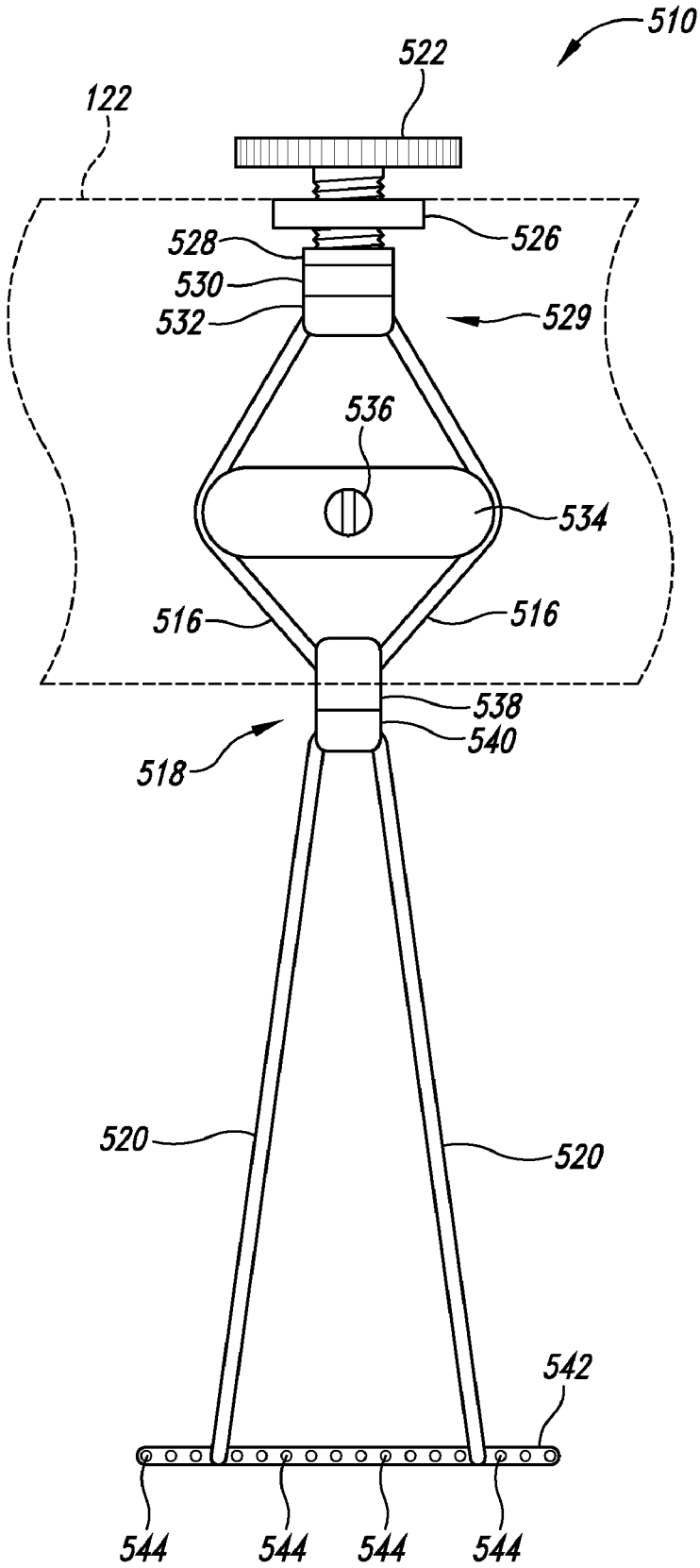
FIG. 54 is a side elevational cross-sectional view of the strainer implementation in the "off" position taken along the 54-54 line of FIG. 49.

When the control lever 512 is horizontally oriented as shown in FIG. 53, the spreader 534 is also horizontally oriented as shown in FIG. 54. While the spreader 534 is horizontally oriented, the upper cord 516 is in a tightened state allowing for the vertical elevation of the connector 518 to be at its highest possible position for a given position of the fine tune screw 522. At this highest position of the connector 518, the lower cord 520 is positioned to allow the cross bar 542 to be positioned so that the snare wires 544 are in a tightened state causing the drum 100 to act as a snare drum at a particular tuning pitch. The fine tune screw 522 can be used to adjust the vertical elevation of the lower connector 518 to adjust tension put on the snare wires 544 if needed for tuning of the snares wires when the spreader 534 is horizontally oriented.

Figure 55:
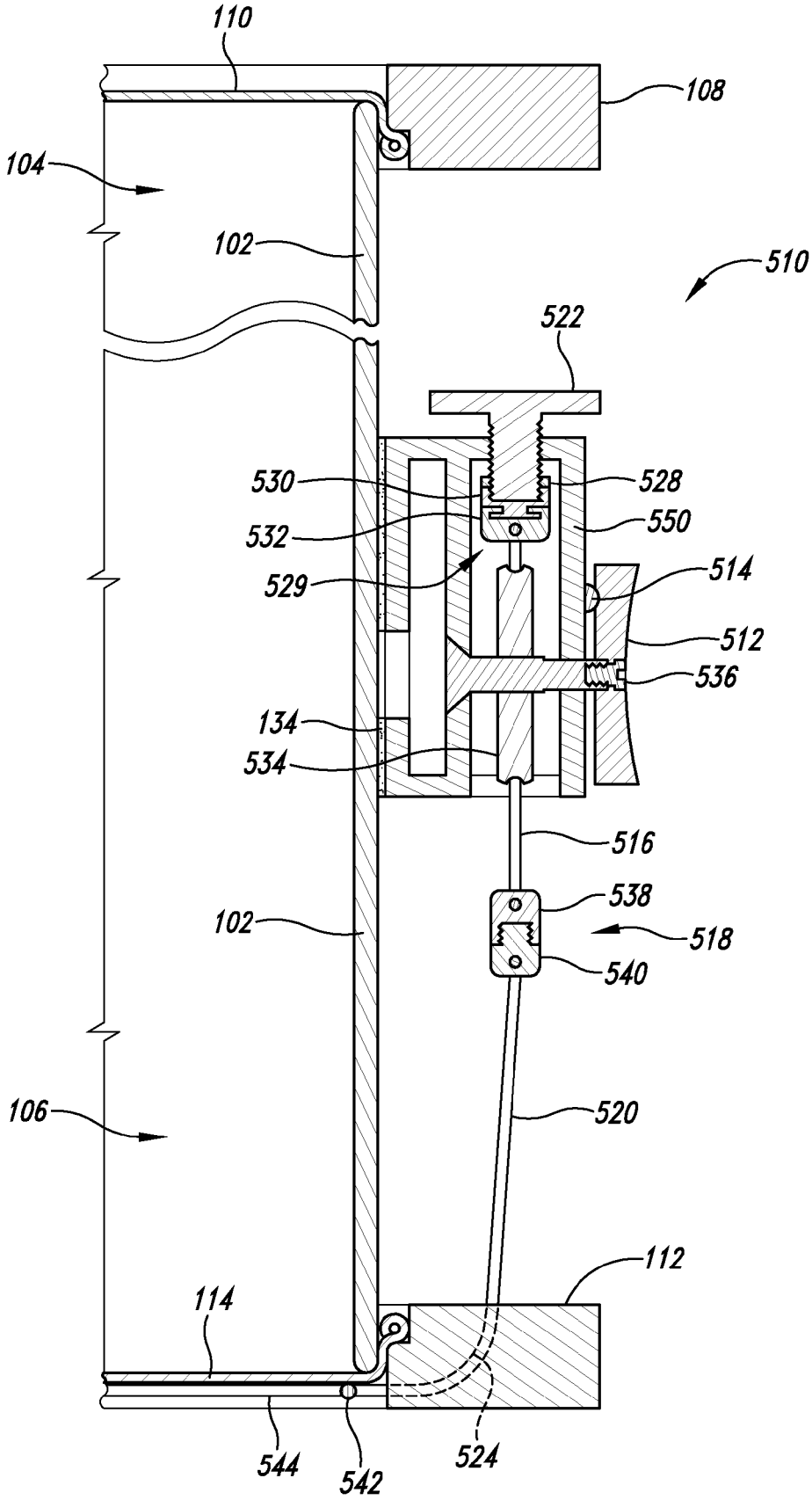
FIG. 55 is a side elevational view showing the strainer assembly coupled to the shell through a brace without need of a peripheral brace.

As shown in FIG. 55, the strainer assembly 510 can be coupled to the shell 102 through a brace 550 without need of the peripheral brace 122.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A drum for an elongated tool member having a first end portion, the drum comprising:

a shell having a first end and a second end;

a first head and a second head;

a first rim coupled to the first head and to the first end of the shell;

a second rim coupled to the second head and to the second end of the shell;

a plurality of coupling members, each having a passageway with a first end portion and a second end portion, each of the coupling members coupled to the shell;

a plurality of first elongated members, each having an longitudinal dimension, having a first end portion rotatably coupled to the first rim, having a second end portion rotatably coupled to the first end portion of the passageway of a different one of the coupling members, and extending therebetween the first rim and the coupling member a first distance, each of the first elongated members rotatably coupled to rotate about the longitudinal dimension to change the first distance and thereby change a first force imparted upon the first rim by the first elongated member, each of the first elongated members having a second passageway extending therethrough the first elongated member along the longitudinal dimension from the first end portion to the second end portion, the second passageway sized to receive a portion of the elongated tool member to allow the portion of the elongated tool member to be removably inserted into the second passageway to extend from the first end portion through the second passageway to position the first end portion of the elongated tool member at a first location outside of the second passageway past the second end portion; and a plurality of second elongated members, each having an longitudinal dimension, having a first end portion rotatably coupled to the second rim, having a second end portion rotatably coupled to the second end portion of the passageway of a different one of the coupling members, and extending therebetween the second rim and the coupling member a second distance, each of the second elongated members rotatably coupled to rotate about the longitudinal dimension to change the second distance and thereby change a second force imparted upon the second rim by the second elongated member, each of the second end portions positioned within the respective coupling member relative to a different one of the first elongated members and configured to engage with the portion of the elongated tool member when the portion of the elongated tool member is positioned at the first location.

2. The drum of claim 1 including a brace member coupled to each of the coupling members, the brace member shaped to extend between each of the coupling members to form a perimeter.

3. The drum of claim 2 wherein the brace member is shaped to form the perimeter that is substantially a circle.

4. The drum of claim 3 wherein the brace member is shaped to form the perimeter that is substantially a polygon.

5. The drum of claim 1 including a plurality of support members coupled to the shell, each of the support members having a passageway through which a portion of a different one of the second elongated members is positioned.

6. The drum of claim 5 including a brace member coupled to each of the coupling members, the brace member shaped to extend between each of the coupling members to form a perimeter.

7. The drum of claim 6 wherein the brace member is shaped to form the perimeter that is substantially a circle.

8. The drum of claim 6 wherein the brace member is shaped to form the perimeter that is substantially a polygon.

9. The drum of claim 1 wherein the coupling members are coupled to the shell without penetration through the shell.

10. The drum of claim 1 wherein in the shell has an external surface and the coupling members are coupled to the external surface of the shell by an adhesive.

11. The drum of claim 10 wherein the adhesive is at least one of the following: adhesive films of thermo plastic polyurethane glue, polyester adhesive films, polyolefin films, adhesive sheets of thermo plastic polyurethane glues, polyester adhesive sheets, polyolefin sheets, urea resin glue, urea formaldehyde glue, cyanoacrylate superglue, polyurethane glue, yellow wood glue, and two-part epoxy glue.

12. The drum of claim 1 wherein the first rim has a plurality of holes and the first end portion of each of the first elongated members has a flange circumferentially extending about the longitudinal dimension of the first elongated member, each of the first elongated members being coupled with the first rim by extending through a different one of the holes with the flange positioned adjacent a surface of the first rim.

13. The drum of claim 1 wherein the second rim has a plurality of holes and the first end portion of each of the second elongated members has a flange circumferentially extending about the longitudinal dimension of the second elongated member, each of the second elongated members being coupled with the second rim by extending through a different one of the holes with the flange positioned adjacent a surface of the second rim.

14. The drum of claim 1 wherein the second end portion of each of the first elongated members is threaded and the first end portion of the passageway of each of the coupling members is threaded, the second end portion of each of the first elongated members being rotatably coupled to the first end portion of a different one of the coupling members by threadable engagement.

15. The drum of claim 1 wherein the second end portion of each of the second elongated members is threaded and the second end portion of the passageway of each of the coupling members is threaded, the second end portion of each of the second elongated members being rotatably coupled to the second end portion of a different one of the coupling members by threadable engagement.

16. The drum of claim 1 wherein the portion of the elongated tool member has an end shaped as a hex wrench and the second end portion of the second elongated member has a slot sized and shaped to engage with the hex wrench shaped end of the portion of the elongated tool member.

17. The drum of claim 1 wherein the elongated tool member has a portion shaped as a socket wrench and the first end portion of each of the first elongated members is shaped to couple with the socket wrench portion of the elongated tool member.

18. A drum comprising:

a shell having a first end and a second end;

a first head and a second head;

a first rim coupled to the first head and to the first end of the shell;

a second rim coupled to the second head and to the second end of the shell;

a plurality of coupling members, each having a first face and a second face, each of the coupling members positioned and coupled to the shell with the first face facing the first rim and the second face facing the second rim, each of the coupling members having a first passageway extending into the coupling member from the first face and a second passageway extending through the coupling member from the first face to the second face, the first passageway and the second passageway being non-coaxial with one another;

a plurality of first elongated members, each having an longitudinal dimension, each having a first end portion rotatably coupled to the first rim and having a second end portion rotatably coupled into the first passageway of a different one of the coupling members and extending therebetween the first rim and the coupling member to impart a first force upon the first rim; and a plurality of second elongated members, each having a longitudinal dimension, each having a first end portion rotatably coupled to the second rim, each having a second end portion extending from a portion of the second face into the second passageway to be accessed from an area adjacent the first face of the coupling member, the second elongated member extending therebetween the second rim and the coupling member a second distance to impart a second force on the second rim.

19. The drum of claim 18 wherein each of the second elongated members extends into the second passageway of the respective coupling members an extent sufficient to extend past the first face at least partially toward the first rim.

20. A drum comprising:

a shell having a first end and a second end;

a first head and a second head;

a first rim coupled to the first head and to the first end of the shell;

a second rim coupled to the second head and to the second end of the shell;

a plurality of coupling members, each having a first face and a second face, each of the coupling members positioned and coupled to the shell with the first face at least partially facing the first rim and the second face at least partially facing the second rim, each of the coupling members having a passageway extending through the coupling member from the first face to the second face; and a plurality of elongated members, each having a first end portion rotatably coupled to the second rim, each having a second end portion extending from a portion of the second face into the passageway to be accessed from an area adjacent the first face of the coupling member, the second elongated member extending therebetween the second rim and the coupling member a second distance to impart a force on the second rim.

21. The drum of claim 20 wherein each of the second elongated members extends into the second passageway of the respective coupling members an extent sufficient to extend past the first face at least partially toward the first rim.

22. A drum for an elongated tool member, the drum comprising:

a shell having a first end and a second end;

a first head and a second head;

a first rim coupled to the first head and to the first end of the shell;

a second rim coupled to the second head and to the second end of the shell;

a plurality of coupling members, each having a passageway with a first end portion and a second end portion, each of the coupling members coupled to the shell;

a plurality of first elongated members, each having an longitudinal dimension, having a first end portion rotatably coupled to the first rim, having a second end portion rotatably coupled to the first end portion of the passageway of a different one of the coupling members, and extending therebetween the first rim and the coupling member a first distance, each of the first elongated members rotatably coupled to rotate about the longitudinal dimension to change the first distance and thereby change a first force imparted upon the first rim by the first elongated member, each of the first elongated members having a second passageway extending therethrough the first elongated member along the longitudinal dimension from the first end portion to the second end portion, the second passageway sized to receive a portion of the elongated tool member to allow the portion of the elongated tool member to be removably inserted into the second passageway to extend from the first end portion through the second passageway to position the first end portion of the elongated tool member at a first location outside of the second passageway past the second end portion; and a plurality of second elongated members, each having an longitudinal dimension, having a first end portion rotatably coupled to the second rim, having a second end portion rotatably coupled to the second end portion of a different one of the first elongated members, and extending therebetween the second rim and the first elongated member a second distance, each of the plurality of second elongated members rotatably coupled to rotate about the longitudinal dimension to change the second distance and thereby change a second force imparted upon the second rim by the second elongated member, each of the second end portions of the second elongated member configured to engage with the portion of the elongated tool member when the portion of the elongated tool member is positioned at the first location.

23. A drum for an elongated tool member having a first end portion, the drum comprising:

a shell having a first end and a second end;

a first head and a second head;

a first rim coupled to the first head and to the first end of the shell;

a second rim coupled to the second head and to the second end of the shell;

a plurality of coupling members, each having a passageway with a first end portion and a second end portion, each of the coupling members coupled to the shell;

a plurality of first elongated members, each having an longitudinal dimension, each having a first end portion rotatably coupled to the first rim; and a plurality of second elongated members, each having an longitudinal dimension, having a first end portion rotatably coupled to the second rim, having a second end portion rotatably coupled to the second end portion of the passageway of a different one of the coupling members, and extending therebetween the second rim and the coupling member a second distance, each of the plurality of second elongated members rotatably coupled to rotate about the longitudinal dimension to change the second distance and thereby change a second force imparted upon the second rim by the second elongated member, each of the plurality of first elongated members having a second end portion rotatably coupled to the second end portion of a different one of the second elongated members and extending therebetween the first rim and the second elongated member a first distance, each of the first elongated members rotatably coupled to rotate about the longitudinal dimension to change the first distance and thereby change a first force imparted upon the first rim by the first elongated member, each of the first elongated members having a second passageway extending therethrough the first elongated member along the longitudinal dimension from the first end portion of the first elongated member to the second end portion of the first elongated member, the second passageway of each of the first elongated members sized to receive a portion of the elongated tool member to allow the portion of the elongated tool member to be removably inserted into the second passageway to extend from the first end portion through the second passageway to position the first end portion of the elongated tool member at a first location outside of the second passageway past the second end portion, each of the second end portions of the second elongated member configured to engage with the portion of the elongated tool member when the portion of the elongated tool member is positioned at the first location.

24. A drum for an elongated tool member having a first end portion, the drum comprising:

a shell having a first end and a second end;

a first head and a second head;

a first rim coupled to the first head and to the first end of the shell;

a second rim coupled to the second head and to the second end of the shell;

a plurality of first coupling members, each having a passageway, each of the first coupling members coupled to the shell;

a plurality of first elongated members, each having an longitudinal dimension, each having a first end portion rotatably coupled to the first rim and having a second end portion rotatably coupled to the passageway of a different one of the first coupling members and extending therebetween the first rim and the first coupling member a first distance, each of the first elongated members rotatably coupled to rotate about the longitudinal dimension to change the first distance and thereby change a first force imparted upon the first rim by the first elongated member, each of the first elongated members having a second passageway extending therethrough the first elongated member along the longitudinal dimension from the first end portion to the second end portion, the second passageway sized to receive a portion of the elongated tool member to allow the portion of the elongated tool member to be removably inserted into the second passageway to extend from the first end portion through the second passageway to position the first end portion of the elongated tool member at a first location outside of the second passageway past the second end portion;

a plurality of second coupling members, each having a passageway, each of the second coupling members coupled to the shell; and a plurality of second elongated members, each having an longitudinal dimension, having a first end portion rotatably coupled to the second rim, having a second end portion rotatably coupled to the the passageway of a different one of the second coupling members and extending therebetween the second rim and the second coupling member a second distance, each of the plurality of second elongated members rotatably coupled to rotate about the longitudinal dimension to change the second distance and thereby change a second force imparted upon the second rim by the second elongated member, each of the second end portions positioned within the respective second coupling member relative to a different one of the first elongated members within the respective first coupling member and configured to engage with the portion of the elongated tool member when the portion of the elongated tool member is positioned at the first location.

25. A drum for an elongated tool member having an end portion, the drum comprising:

a shell having a first end and a second end;

a first head and a second head;

a first rim coupled to the first head and to the first end of the shell, the first rim having a plurality of passageways through the first rim;

a second rim coupled to the second head and to the second end of the shell;

a plurality of coupling members, each having a passageway extending through the coupling member, each of the coupling members coupled to the shell such that the passageway of the coupling member is substantially coaxially located with a different one of the passageways of the first rim; and a plurality of elongated members, each having a longitudinal dimension, having a first end portion rotatably coupled to the second rim, having a second end portion rotatably coupled into the passageway of a different one of the coupling members, the second end portion of each of the plurality of elongated members configured to engage with the end portion of the elongated tool member and positioned within the passageway to engage with the end portion of the elongated tool member when the elongated tool member is positioned to extend through the passageway of the respective coupling member to the second end portion, the elongated member extending therebetween the second rim and the respective coupling member a distance, each of the elongated members rotatably coupled to rotate about the longitudinal dimension to change the distance and thereby change a force imparted upon the second rim by the elongated member.

26. The drum of claim 25 including:

a plurality of second coupling members; and a plurality of second elongated members, each of the second elongated members having an longitudinal dimension, each having a first end portion rotatably coupled to the first rim and having a second end portion rotatably coupled into a different one of the second coupling members and extending therebetween the first rim and the second coupling member a second distance, each of the second elongated members rotatably coupled to rotate about the longitudinal dimension to change the second distance and thereby change a second force imparted upon the first rim by the second elongated member.

27. A drum comprising:

a shell having a first end and a second end;

a first head and a second head;

a first rim coupled to the first head and to the first end of the shell;

a second rim coupled to the second head and to the second end of the shell;

a plurality of coupling members, each having a passageway with a first end portion and a second end portion, each of the coupling members coupled to the shell;

a plurality of elongated engagement members each having a first end portion and a second end portion, each of the elongated engagement members having a first engagement portion located on the elongated engagement member other than on the second end portion, the second end portion having a second engagement portion;

for each of the plurality of the elongated engagement members, a plurality of first elongated members, each having an longitudinal dimension, having a first end portion rotatably coupled to the first rim and having a second end portion rotatably coupled to the passageway of a different one of the coupling members, and extending therebetween the first rim and the coupling member a first distance, each of the first elongated members rotatably coupled to rotate about the longitudinal dimension to change the first distance and thereby change a first force imparted upon the first rim by the first elongated member, each of the first elongated members having a passageway extending therethrough the first elongated member along the longitudinal dimension from the first end portion to the second end portion, the passageway of the first elongated member positioned to receive a different one of the plurality of elongated engagement members and sized for the elongated engagement member to be moved inside of the passageway at least between a first position and a second position, the passageway of each of the first elongated members having an engagement portion configured to engage with the first engagement portion of the respective elongated engagement member when the elongated engagement member is at the first position in the passageway; and a plurality of second elongated members, each having an longitudinal dimension, having a first end portion rotatably coupled to the second rim, having a second end portion rotatably coupled to the second end portion of the passageway of a different one of the coupling members, and extending therebetween the second rim and the coupling member a second distance, each of the plurality of second elongated members rotatably coupled to rotate about the longitudinal dimension to change the second distance and thereby change a second force imparted upon the second rim by the second elongated member, the second end portion of each of the second elongated members positioned within the respective coupling member relative to a different one of the first elongated members and configured to engage with the second engagement portion of a different one of the elongated engagement members when the elongated engagement member is in the second position in the passageway of the respective first elongated member.

28. The drum of claim 1 including a spring positioned to have an amount of compression when the elongated engagement member is in the second position in the passageway of the first elongated member.

* * * * *